US011241088B2

(12) United States Patent
Taylor

(10) Patent No.: US 11,241,088 B2
(45) Date of Patent: Feb. 8, 2022

(54) PORTABLE STAND FOR PORTABLE ELECTRONIC DEVICES

(71) Applicant: Kyle Taylor, Bend, OR (US)

(72) Inventor: Kyle Taylor, Bend, OR (US)

( * ) Notice: Subject to any disclaimer, the term of this patent is extended or adjusted under 35 U.S.C. 154(b) by 0 days.

(21) Appl. No.: 17/157,721

(22) Filed: Jan. 25, 2021

(65) Prior Publication Data

US 2021/0145167 A1 May 20, 2021

Related U.S. Application Data

(63) Continuation of application No. 16/352,563, filed on Mar. 13, 2019, now Pat. No. 10,932,563.

(60) Provisional application No. 62/644,574, filed on Mar. 18, 2018.

(51) Int. Cl.

| | |
|---|---|
| ***A47B 23/00*** | (2006.01) |
| ***A47B 23/04*** | (2006.01) |
| ***A47B 21/04*** | (2006.01) |

(52) U.S. Cl.

CPC ..... *A47B 23/043* (2013.01); *A47B 21/04* (2013.01); *A47B 2023/049* (2013.01)

(58) Field of Classification Search

None

See application file for complete search history.

(56) References Cited

U.S. PATENT DOCUMENTS

| | | | | |
|---|---|---|---|---|
| 5,335,753 | A * | 8/1994 | Campbell | B25H 1/06 182/151 |
| 5,868,373 | A * | 2/1999 | Duff | A47B 23/044 248/459 |
| 6,338,216 | B1 * | 1/2002 | Young | A47B 97/08 248/444.1 |
| 6,352,233 | B1 | 3/2002 | Barberich | |
| 6,819,548 | B2 | 11/2004 | Hillis et al. | |
| 7,916,468 | B2 | 3/2011 | Takizawa | |
| 9,433,287 | B2 | 9/2016 | Chen et al. | |
| 9,874,307 | B1 | 1/2018 | Del Castillo | |
| 9,942,998 | B1 * | 4/2018 | Mayes | H04M 1/04 |
| D835,115 | S | 12/2018 | Westergard et al. | |
| 10,674,815 | B1 * | 6/2020 | Geller | H05K 5/0234 |
| 2009/0179124 | A1 | 7/2009 | Caplan | |
| 2009/0321605 | A1 | 12/2009 | Petrie | |
| 2018/0035799 | A1 * | 2/2018 | Leafgren | A47B 23/00 |
| 2020/0191533 | A1 * | 6/2020 | Lovell, III | F41J 1/10 |

* cited by examiner

*Primary Examiner* — Steven M Marsh
(74) *Attorney, Agent, or Firm* — Jose R. Mata

(57) ABSTRACT

In some embodiments a portable stand for supporting portable electronic devices when the portable stand is resting on a flat surface includes a panel-shaped top piece and a panel-shaped bottom piece. The top and the bottom pieces are configured to be interlocked to form an interlocking structure with an X shape when viewed via a view substantially orthogonal to the flat surface when resting on the flat surface in a first position. The interlocking structure is configured to be interchangeably positioned in the first position for presenting a support structure for supporting a laptop computer and at least one of a second position for presenting a tablet slot for supporting a tablet computer, or a third position for presenting an e-reader slot for supporting at least an e-reader.

20 Claims, 24 Drawing Sheets

PORTABLE STAND FOR PORTABLE ELECTRONIC DEVICES

PRIORITY APPLICATION

The present application is a CONTINUATION of U.S. patent application Ser. No. 16/352,563 entitled "PORTABLE STAND FOR PORTABLE ELECTRONIC DEVICES" filed on Mar. 13, 2019, which claims priority to U.S. Provisional Patent Application Ser. No. 62/644,574 entitled "PORTABLE STAND FOR PORTABLE ELECTRONIC DEVICES" and filed on Mar. 18, 2018. U.S. patent application Ser. No. 16/352,563 is hereby fully incorporated by reference herein in its entirety.

TECHNICAL FIELD OF EMBODIMENTS

Certain embodiments pertain to a portable stand for supporting portable electronic devices, such as laptop computers, tablet computers, e-readers, and smart phones. More so, certain embodiments pertain to a portable stand for supporting portable electronic devices, such as laptop computers, tablet computers, e-readers, and smart phones that is easy to transport.

BACKGROUND

Portable electronic devices, such as laptop computers, tablet computers, e-readers, and smart phones have become commonplace. The ubiquitous nature of portable electronic devices across multiple demographics has led to an increase in repetitive use injuries with technology users. One example being a portable laptop, that when located on a support structure such as a table or desk, the screen may be significantly below eye level of the user. This arrangement may cause the users to have poor posture while leaning over, head down, to view the screen. This can lead to back and neck strain or damage through continued use and exposure.

Placement of a portable electronic device on a stand may improve the ergonomic use of a portable electronic device. Factors include whether the portable electronic device is supported at a height that does not require a user to have poor posture leaning over, head down, to view the screen. Thus one design consideration in designing a stand is whether a portable electronic device is supported at a height that does not require poor posture on the part of a user.

Another design consideration is whether the stand is portable and easy to carry. Since the stand is for portable electronic devices that may be carried from place to place by a user, it is convenient if the stand for the portable electronic device is itself portable.

Another design consideration is the versatility of a portable stand. A user may carry more than one of a laptop computer, a tablet computer, an e-reader, or a smart-phone. A user should not be required to carry a different portable stand for each of those devices. Thus, it is desirable if a single portable stand could be used with two or more of the above types of devices.

Yet another design consideration is use of a minimal number of parts. A portable stand that does not require a user to carry tools or multiple fastening devices to use with the portable stand is desirable.

Thus, there is a need for a portable stand that includes a number of desirable design configurations.

SUMMARY OF EXEMPLARY EMBODIMENT(S)

This summary is provided as a convenience to the reader as a summary of one or more embodiments. The discussion in this Summary is intentionally simplified. It is not intended as a guide for construing or limiting the scope of the claims.

In some embodiments a portable stand may be configured for supporting portable electronic devices when the portable stand is resting on a flat surface. The portable stand may include a panel-shaped top piece defining first, second, third, and fourth edges with the first edge opposing the third edge and the second edge opposing the fourth edge. The portable stand may further include a panel-shaped bottom piece defining first, second, third, and fourth edges with the first edge opposing the third edge and the second edge opposing the fourth edge.

The top and the bottom pieces may be configured to be interlocked to form an interlocking structure with an X shape when viewed via a view substantially orthogonal to the flat surface when at least a portion of the third edges of the top and bottom pieces are resting on the flat surface.

The interlocking structure may be configured to be interchangeably positioned in at least a first position and at least one of a second or a third position. The first position may include at least a portion of the third edges of the top and bottom pieces resting on the flat surface and the first edges facing upward relative to the flat surface and defining a support structure for supporting a laptop computer, the support structure sloping between 5 and 15 degrees downward relative to horizontal, the horizontal being relative to the flat surface, in a direction away from a rear-side of the interlocking structure defined by the second edges and toward a front-side of the interlocking structure defined by the fourth edges.

The second position may include at least a portion of the second edges of the top and bottom pieces resting on the flat surface with the fourth edges facing upward relative to the flat surface and defining a tablet slot for supporting a tablet computer in an orientation between 0 and 30 degrees of vertical relative to the flat surface.

The third position may include at least a portion of the first edges of the top and bottom pieces resting on the flat surface with the third edges facing upward relative to the flat surface and defining an e-reader slot for holding an e-reader in an orientation between 0 and 45 degrees of vertical relative to the flat surface.

BRIEF DESCRIPTION OF THE DRAWINGS

Various embodiments will now be described, by way of example, with reference to the accompanying drawings. In these drawings FIGS. 1-9 include features and/or combination of features of the portable stand that have utility applications as discussed herein.

FIG. 1 is a perspective view of an embodiment of a portable stand for portable electronics devices that is assembled to form an interlocking structure, showing utilitarian and ornamental features.

FIG. 2 is a front view of the portable stand of FIG. 1, showing utilitarian and ornamental features.

FIG. 3 is a rear view of the portable stand of FIG. 1, showing utilitarian and ornamental features.

FIG. 4 is left side view of the portable stand of FIG. 1, showing utilitarian and ornamental features.

FIG. 5 is a right side view of the portable stand of FIG. 1, showing utilitarian and ornamental features.

FIG. 6 is a top view of the portable stand of FIG. 1, showing utilitarian and ornamental features.

FIG. 7 is bottom view of the portable stand of FIG. 1, showing utilitarian and ornamental features.

FIG. 8 is an assembly drawing showing assembly of the portable stand of FIG. 1, showing utilitarian and ornamental features.

FIG. 9 illustrates, consistent with some embodiments, a frontal perspective view of an embodiment of a portable stand for portable electronics devices that is assembled to form an interlocking structure and that is situated on a flat surface. A point of view for FIG. 2 and other side views in FIGS. 10-24 is illustrated by line L1. A point of view for FIG. 16 and other front views in FIGS. 10-24 is illustrated by line L2.

DETAILED DESCRIPTION

Some embodiments are now described with reference to the above-described figures. In the following description, reference is often made to "some embodiments." These references to "some embodiments" are not necessarily referring to the same embodiments, as numerous and varied embodiments are possible. In addition, the drawings are simplified drawings which omit various details to focus on what is described in this detailed description. The omission of various details is not intended to imply that these various details would not be present in an actual physical embodiment. Instead, omissions of various details are merely to avoid clutter in the presentation and to aid ease of explanation and understanding. Further, these simplified drawings are intended to illustrate the principles of various described embodiments and are not necessarily drawn to scale. All descriptions of angles, degrees, or measurements are examples and not intended to be limiting.

Some embodiments include a portable stand that is capable of being rotated relative to a flat surface to be interchangeably placed into up to three different positions. In a first position a support structure is provided suitable for use of a laptop computer. In some embodiments this support structure is provided at a height (e.g. relative to a desktop) that is ergonomically desirable for a user using the laptop (e.g., sitting on a chair in front of the desktop). In a second position a tablet slot is provided suitable for use of a tablet computer. In a third position an e-reader slot is provided suitable for use of an e-reader. The e-reader slot may, in some embodiments, also be sized and shaped to be suitable for use of a smart phone in a landscape or horizontal position. In some embodiments, when in the first position the portable stand includes an extension piece to raise the laptop computer to a higher, secondary, level if desired.

In some embodiments the portable stand is composed of flat pieces that can be disassembled and stacked into a stacked set of pieces for easy carrying. In particular embodiments a keeper pin may prevent the stacked set of pieces from shearing or sliding. The pieces may be held together via attachment mechanism, such as strategically placed magnets. In some further embodiments, the stacked pieces may define a handle for easy carrying of the set of stacked pieces. Thus, in some embodiments a portable stand is provided which is versatile in that it can be used in different positions for a variety of different types, sizes, and shapes of computing devices. And which is also, in some embodiments, capable of being conveniently collapsed into a set of stacked pieces, perhaps with a handle, for easy carrying.

Figure 14:
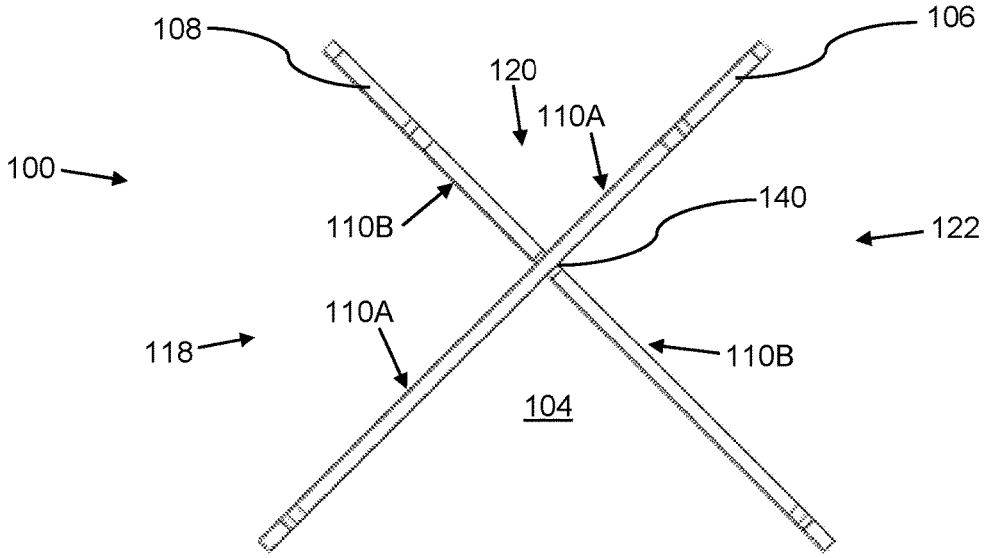
FIG. 14 illustrates, consistent with some embodiments, a top view of the portable stand of FIG. 9 in position one showing X shape of interlocking structure. The top view is view orthogonal to flat surface.
Figure 47:
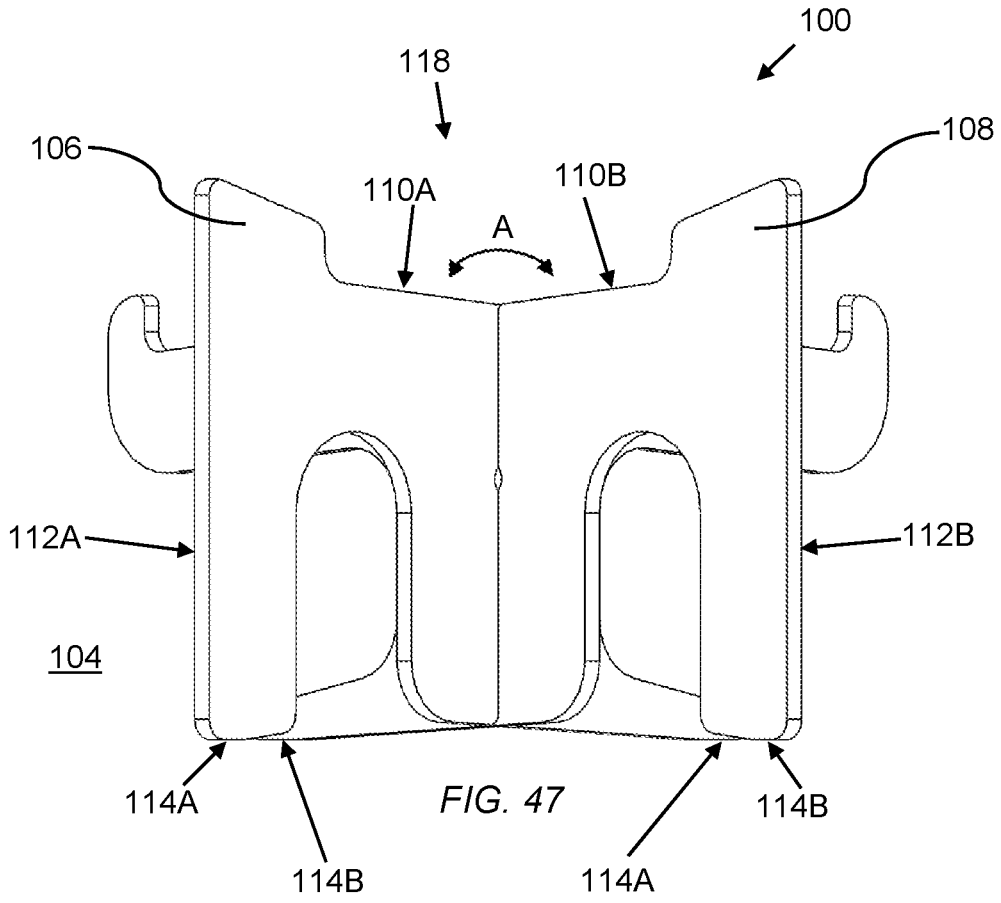
FIG. 47 illustrates a rear view (opposite Line L2 of FIG. 9) of the portable stand of FIG. 9 in position one.

Proceeding to describe some embodiments with reference to FIGS. 1-7, 9-24, and 47 in some embodiments a portable stand 100 is configured for supporting portable electronic devices (e.g. at least one of a laptop computer 130, a table computer 132, an e-reader 134, or a smart phone 135) when the portable stand 100 is resting on a flat surface 104. In some embodiments the portable stand 100 includes a panel-shaped top piece 106 defining first 110A, second 112A, third 114A, and fourth 116A edges with the first edge 110A opposing the third edge 114A and the second edge 112A opposing the fourth edge 116A. In some embodiments the portable stand 100 further includes a panel-shaped bottom piece 108 defining first 110B, second 112B, third 114B, and fourth 116B edges with the first edge 110B opposing the third edge 114B and the second edge 112B opposing the fourth edge 116B; wherein the top 106 and the bottom 108 pieces are configured to be interlocked to form an interlocking structure 118 with an X shape 120 (e.g., as shown in FIG. 14) when viewed via a view substantially orthogonal to the flat surface 104 (e.g., as shown in FIG. 14) when at least a portion of the third edges 114A, 114B of the top 106 and bottom 108 pieces are resting on the flat surface 104. For example, in FIG. 9 at least a portion of third edges 114A, 114B are shown resting on flat surface. FIG. 14 shows a top view of the portable stand 100 in the orientation shown in FIG. 9 and the X shape 120 is visible. In some embodiments, in an interlocking structure 118 an angle defined between intersecting top piece 106 and bottom piece 108 is a right angle (e.g., Angle A of FIGS. 9, 47 defined by intersecting top and bottom pieces 106, 108 is a right angle).

In this document, the term "interlocking structure" is used to refer to the portable stand 100 with the top piece 106 and the bottom piece 108 are interlocked (e.g. assembled) to render the portable stand ready for use. As discussed in more detail below, the portable stand 100 is capable of being disassembled for transport, and when so disassembled, is not referred to as an interlocking structure.

In addition, in discussing FIGS. 9-24 in particular, a figure is sometimes discussed as illustrating as "side" view or a "front view." However, as discussed in more detail below, various embodiments of the portable stand are capable of being placed (e.g. rotated relative to flat surface 104) into various different positions. Therefore, the terms "side view" and "front view" are used to refer to a point of view, or a direction of view, rather than by what portion of the portable stand might be closest to a hypothetical viewer. Unless otherwise indicated, in FIGS. 9-24 a side view is a view viewing the portable stand at least approximately in a point of view (or line of sight) in the direction indicated by Line L1 of FIG. 9. Additionally, unless otherwise indicated, in FIGS. 9-24 a front view is a view viewing the portable stand at least approximately in a point of view (or line of sight) in the direction indicated by Line L2 of FIG. 9. This discussion also applies to the Brief Discussion of the Drawings above.

Figure 9:
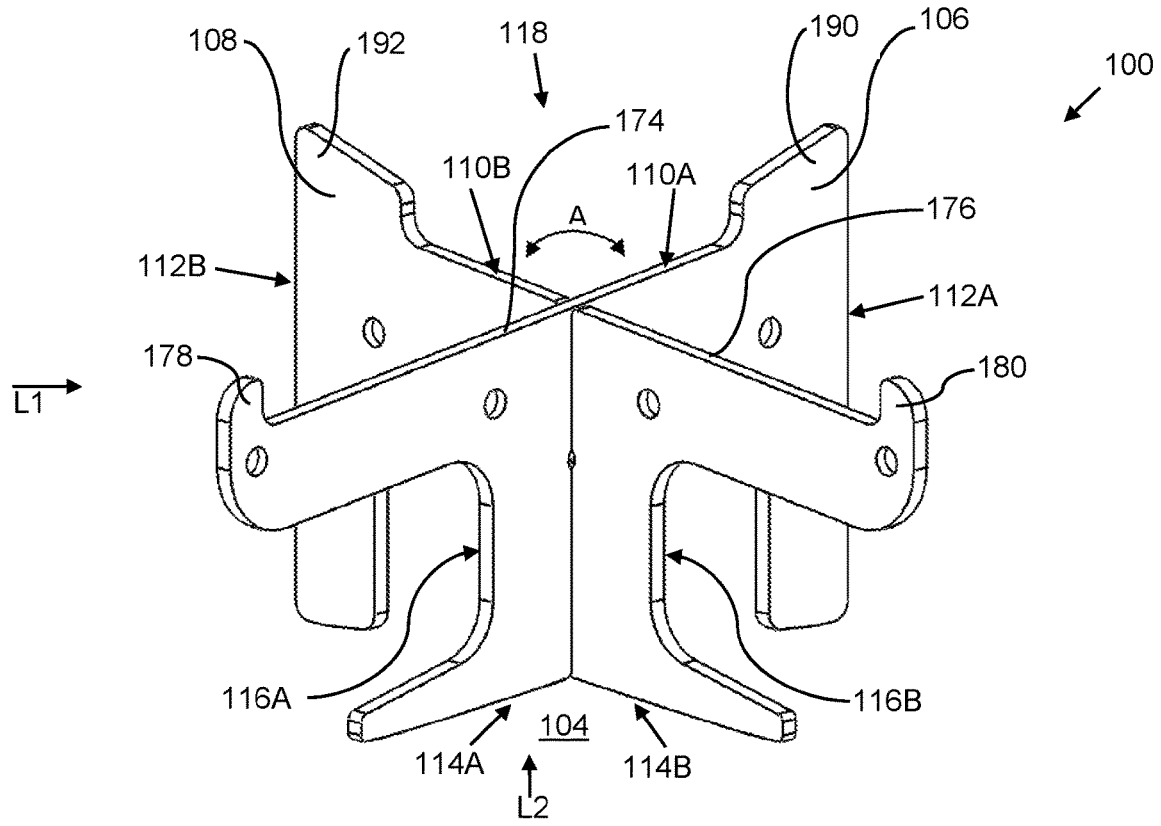
Figure 10:
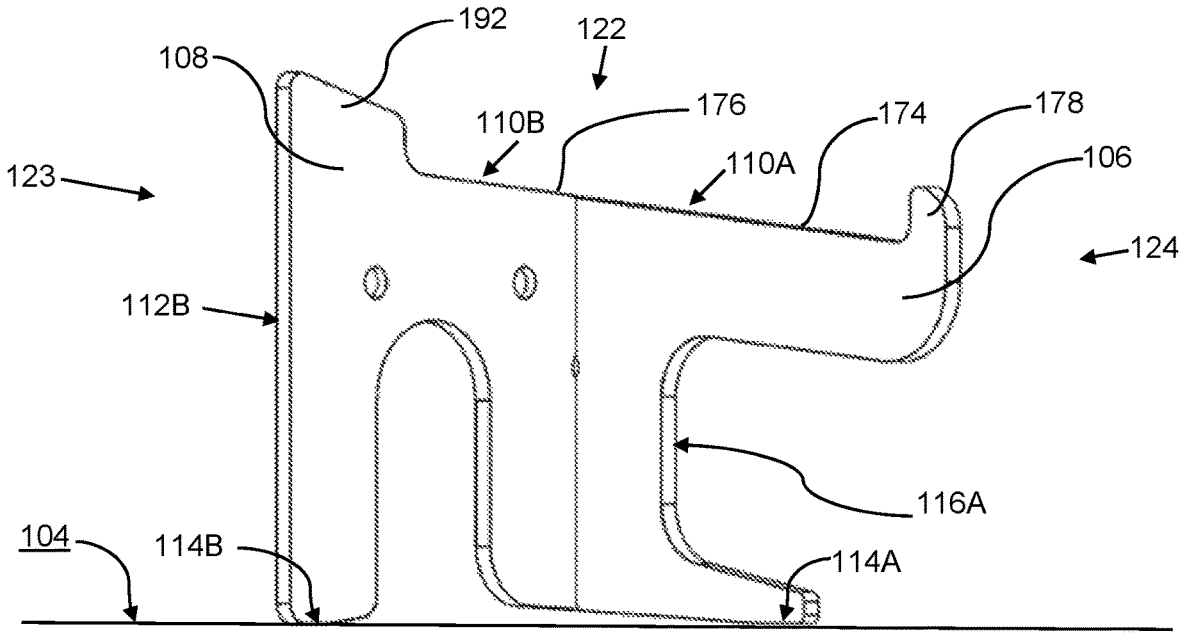
FIG. 10 illustrates, consistent with some embodiments, a side view (based of line L1 of FIG. 9) of the portable stand of FIG. 9 in a position one, relative to surface 104.
Figure 15:
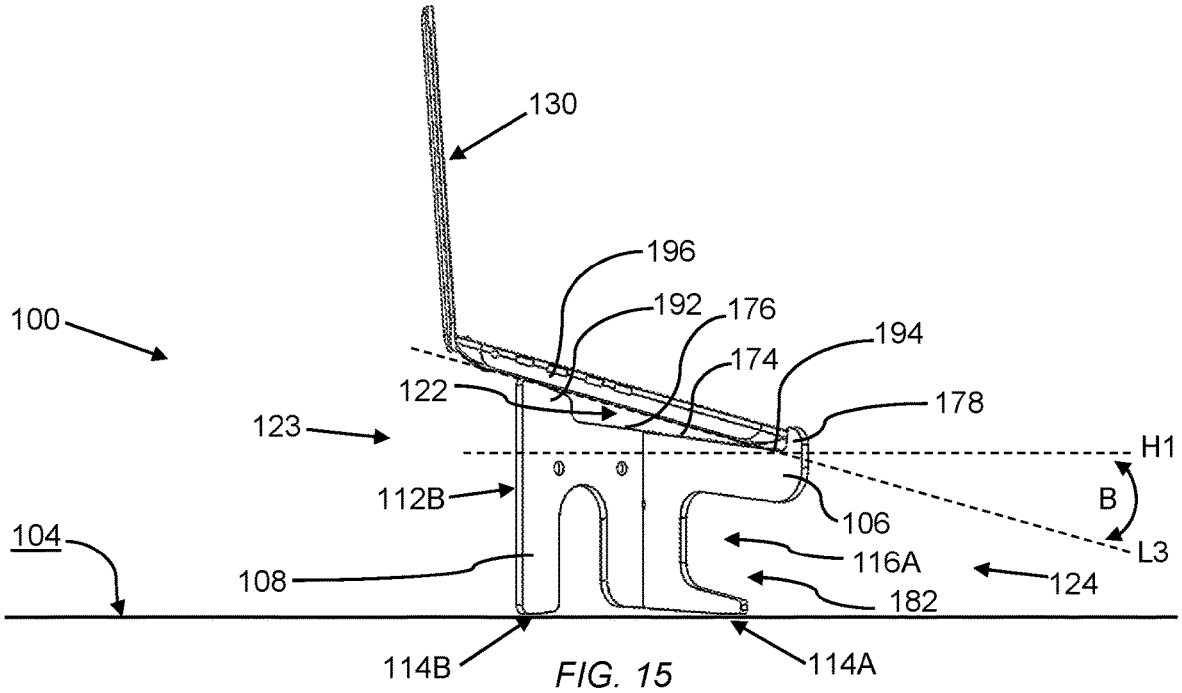
FIG. 15 illustrates, consistent with some embodiments, a side view of the portable stand of FIG. 9 in position one supporting a laptop computer on its support structure.
Figure 16:
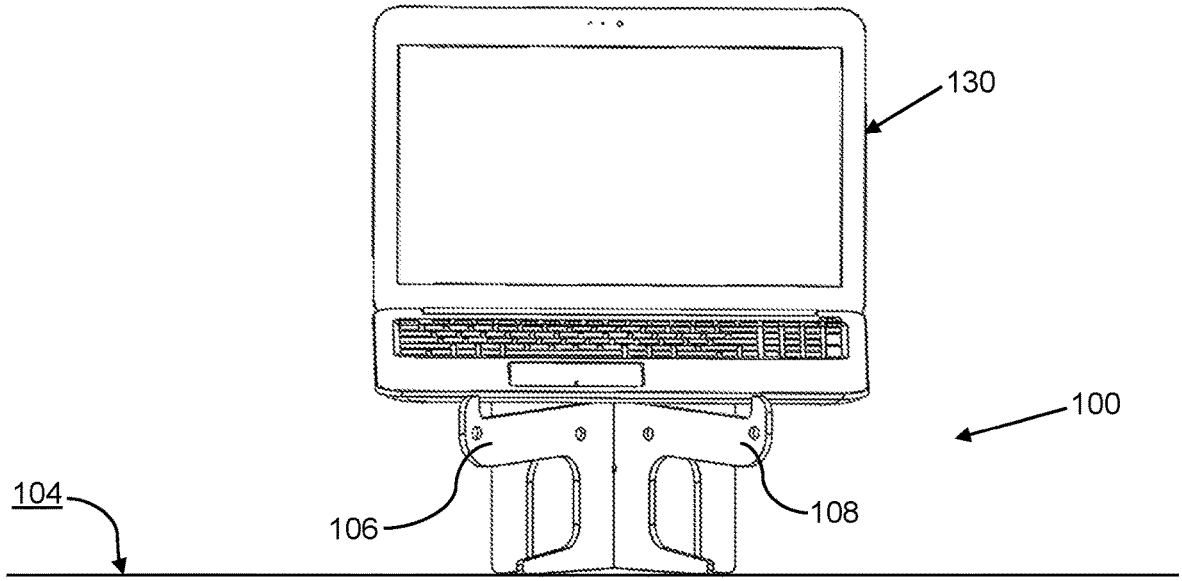
FIG. 16 illustrates, consistent with some embodiments, a front view (consistent with direction of view of Line L2 of FIG. 9) of the portable stand and laptop computer of FIG. 15 (supporting structure not in view).

Moving forward to discuss further embodiments with reference to FIGS. 10, 13, 15, 20, and 21, in some embodiments, the interlocking structure 118 is configured to be interchangeably positioned in at least a first position with at least a portion of the third edges 114A, 114B of the top 106 and bottom 108 pieces resting on the flat surface 104 and the first edges 110A, 110B facing upward relative to the flat surface 104 and defining a support structure 122 for supporting a laptop computer (e.g., laptop computer 130 of FIGS. 15, 20 and 21), the support structure 122 sloping between 5 and 15 degrees (e.g. per Angle B defined by Lines L3 and H1 of FIG. 15) relative to horizontal (e.g., Line H1), the horizontal being relative to the flat surface 104, in a direction away from a rear-side 123 (e.g., as shown in at least FIGS. 10, 15) of the interlocking structure 118 defined by the second edges 112A, 112B (see e.g., Edge 112B of at least FIGS. 10 and 15) and toward a front-side 124 of the interlocking structure 118 defined by the fourth edges 116A, 116B (see e.g. edge 116A of FIGS. 10, 15 and edges 116A, 116B of FIG. 9).

Figure 11:
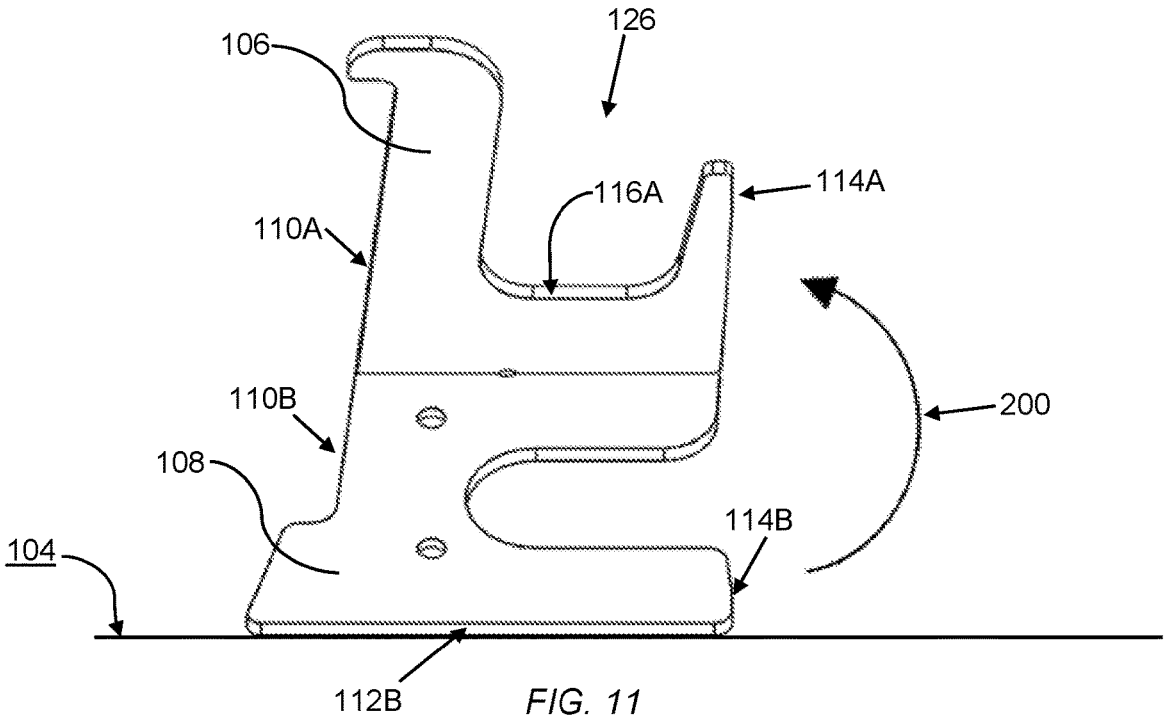
FIG. 11 illustrates, consistent with some embodiments, a side view of the portable stand of FIG. 9 in a position two, relative to surface 104.
Figure 12:
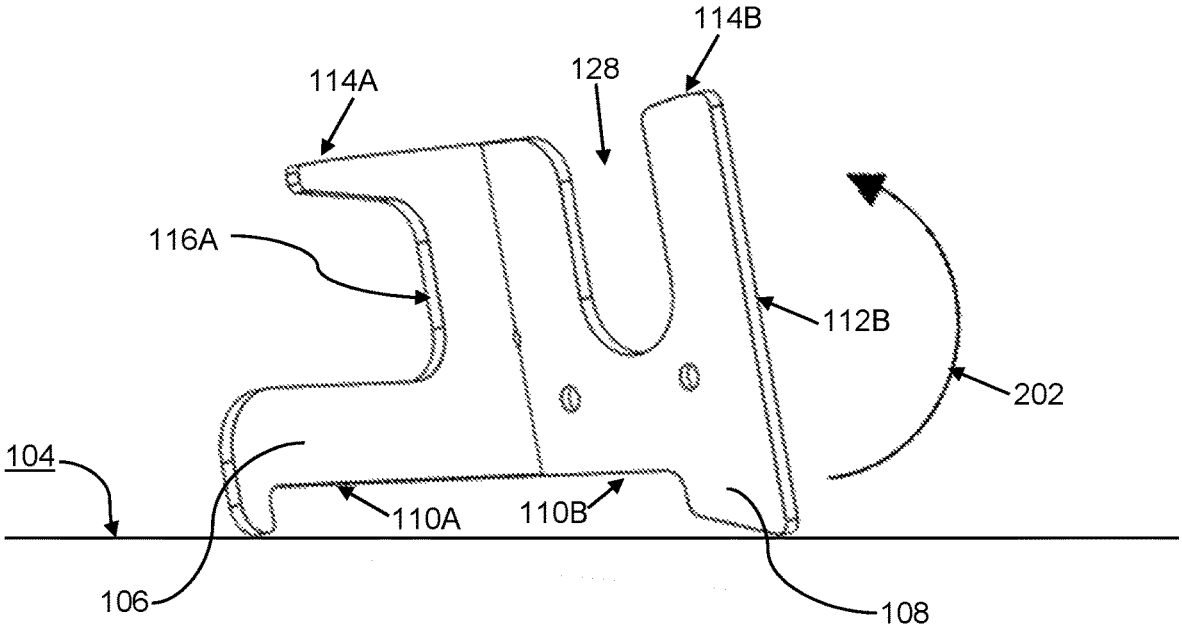
FIG. 12 illustrates, consistent with some embodiments, a side view of the portable stand of FIG. 9 in a position three, relative to surface 104.
Figure 13:
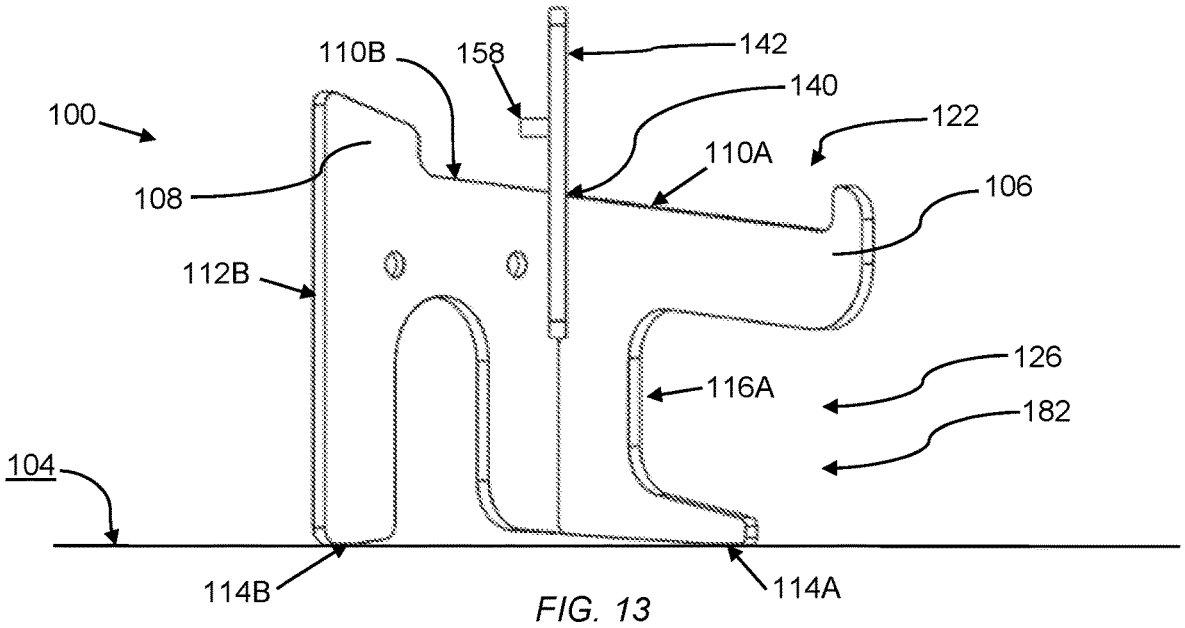
FIG. 13 illustrates, consistent with some embodiments, a side view of the portable stand of FIG. 9 in position one with an extender piece attached to the interlocking structure.
Figure 17:
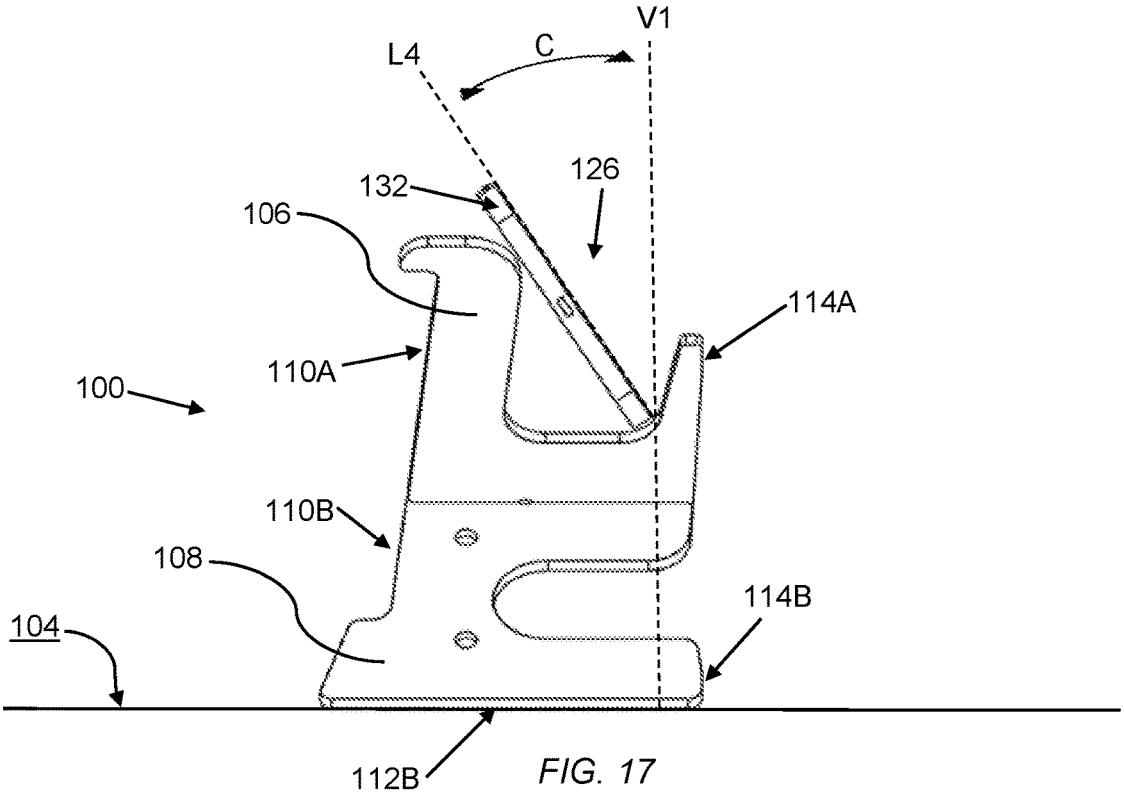
FIG. 17 illustrates, consistent with some embodiments, a side view of the portable stand of FIG. 9 in position two supporting a tablet computer in its tablet slot.
Figure 22:
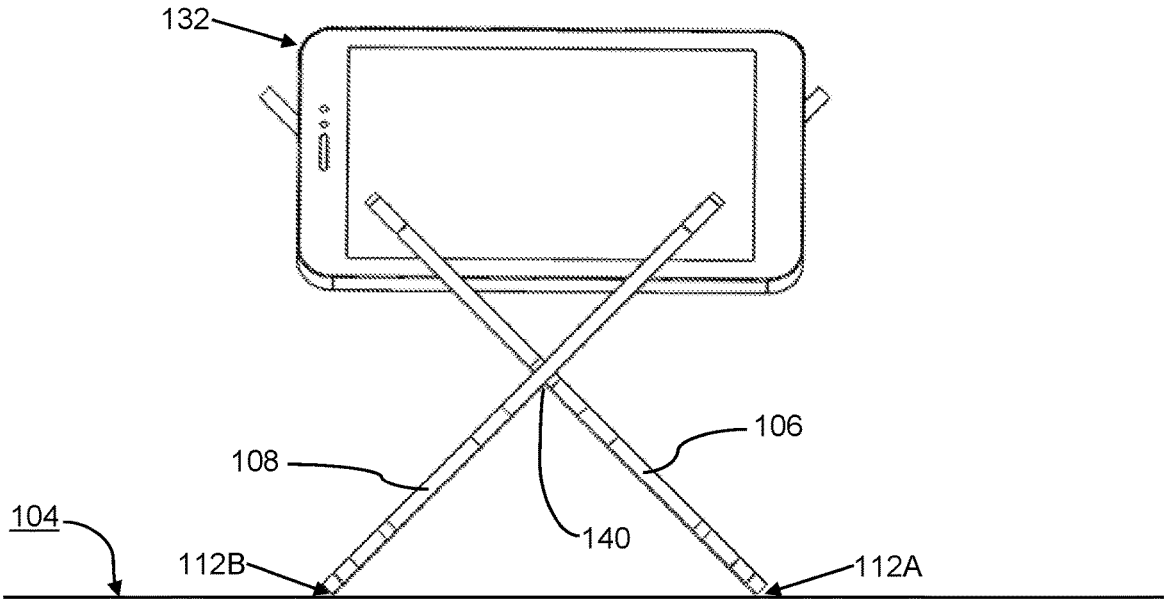
FIG. 22 illustrates, consistent with some embodiments, a front view of the portable stand of FIG. 9 in position two supporting a tablet computer in a landscape or horizontal orientation in its tablet slot.
Figure 23:
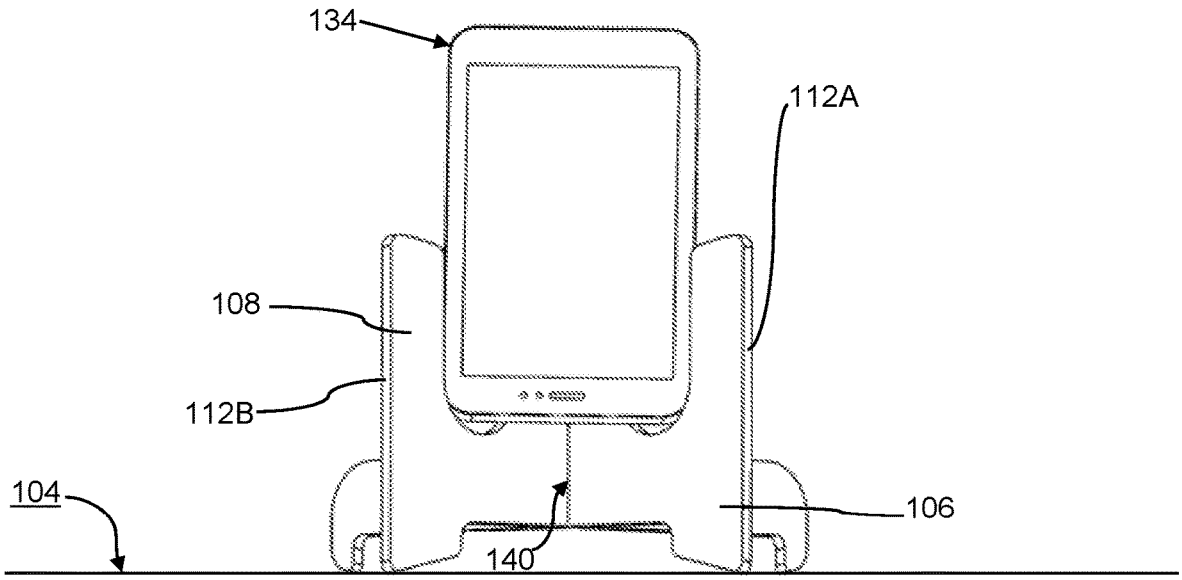
FIG. 23 illustrates, consistent with some embodiments, a front view of the portable stand of FIG. 9 in position three supporting an e-reader in a vertical orientation in its e-reader slot.
Figure 24:
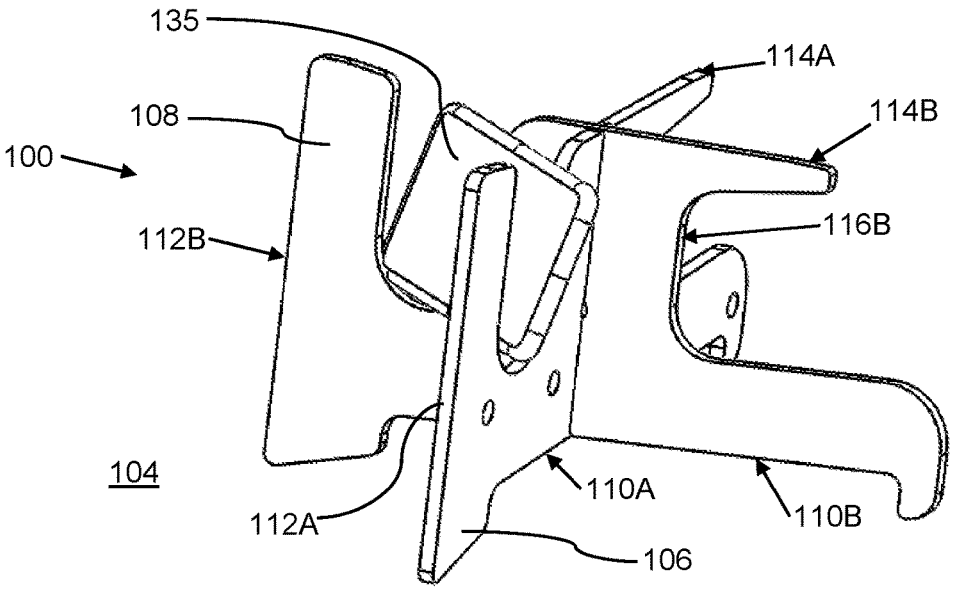
FIG. 24 illustrates, consistent with some embodiments, a perspective view of the portable stand of FIG. 9 in position three supporting a smart phone in a landscape or horizontal orientation in its e-reader slot.

Moving forward to discuss further embodiments with reference to FIGS. 11, 17, and 22 in some embodiments, the interlocking structure 118 is further configured to be interchangeably positioned in at least a second position with at least a portion of the second edges 112A, 112B of the top 106 and bottom 108 pieces resting on the flat surface 104 with the fourth edges 116A, 116B facing upward relative to the flat surface 104 and defining a tablet slot 126 for supporting a tablet computer (e.g., tablet computer 132 of FIGS. 17, 22 (landscape orientation)) in an orientation between 0 and 30 degrees (e.g., where Angle C of FIG. 17, defined by Lines L4 and V1 is between 0 and 30 degrees) of vertical (e.g., as depicted by Line V1 of FIG. 17) relative to the flat surface 104. In some embodiments, a portable stand 100 is not configured to be placed in a second position because, for example, it lacks a tablet slot 126.

In some embodiments a portable stand 100 is configured (e.g., by shape of portable stand 100, including respective positions of edges) to be moved from a first position to a second position by being rotated relative to flat surface 104. For example, a portable stand 100 in a first position, as shown in FIG. 10, may be configured to be rotated (e.g., as indicted by Arrow 200 of FIG. 11) into second position. That is rotated so that portable stand instead of at least partly resting on edges 114A, 114B is instead resting on at least a portion of second edges 112A, 112B. This is made possible by at least second edges 112A, 112B being adjacent to and at an angle to third edges 114A, 114B.

Moving forward to discuss further embodiments with reference to FIGS. 12, 18, 19, 23, and 24, in some embodiments, the interlocking structure 118 is further configured to be interchangeably positioned in at least a third position with at least a portion of the first edges 110A, 110B of the top 106 and bottom 108 pieces resting on the flat surface 104 with the third edges 114A, 114B facing upward relative to the flat surface 104 and defining an e-reader slot 128 configured for holding an e-reader (e.g., e-reader 134 of FIGS. 18, 23) in an orientation between 0 and 45 degrees (e.g., where Angle D1 of FIG. 18 defined by Lines L5 and V2 is between 0 and 45 degrees) of vertical (e.g., as depicted by Line V2 of FIG. 18) relative to the flat surface 104. In some embodiments, the e-reader slot 128 is also configured for holding smart phone 135 (e.g., smart phone 135 of FIGS. 19, 24 in a horizontal or landscape orientation relative to floor 104) in an orientation between 0 and 45 degrees (e.g., where Angle D2 of FIG. 19 defined by Lines L6 and V3 is between 0 and 45 degrees of vertical (e.g., as depicted by Line V3 of FIG. 19) relative to the flat surface 104. In some embodiments, a portable stand 100 is not configured to be placed in a third position because, for example, it lacks an e-reader slot 126.

In some embodiments a portable stand 100 is configured (e.g., by shape of portable stand 100, including respective positions of edges) to be moved from a second position to a third position by being rotated relative to flat surface 104. For example, a portable stand 100 in a second position, as shown in FIG. 11, may be configured to be rotated (e.g., as indicted by Arrow 202 of FIG. 12) into third position. That is rotated so that portable stand instead of at least partly resting on second edges 112A, 112B is instead resting on at least a portion of first edges 110A, 110B. This is made possible by at least first edges 110A, 110B being adjacent to and at an angle to second edges 112A, 112B.

It should be noted that different embodiments will be configured for being placed in various combinations of positions one, two, and three. For example, one embodiment may be configured for being interchangeably placed in any one of positions one in which a support structure 122 is provided, position two in which a tablet slot 126 is provided, and position three in which an e-reader slot 128 is provided. Other embodiments may not provide at least one of the second or third positions (e.g., lacking either tablet slot 126 or an e-reader slot 128). For example, one embodiment may only be configured to be interchangeably placed in any one of positions one in which a support structure 122 is provided and position two in which a tablet slot 126 is provided, but is not configured for a third position with an e-reader slot 128 (e.g., not having an e-reader slot 128). Another embodiment may only be configured to be interchangeably placed in any one of positions one in which the support structure 122 is provided and position three in which an e-reader slot 128 is provided, but not into a position two in which a tablet slot 126 is provided (e.g., not having a tablet slot 126).

Figure 35:
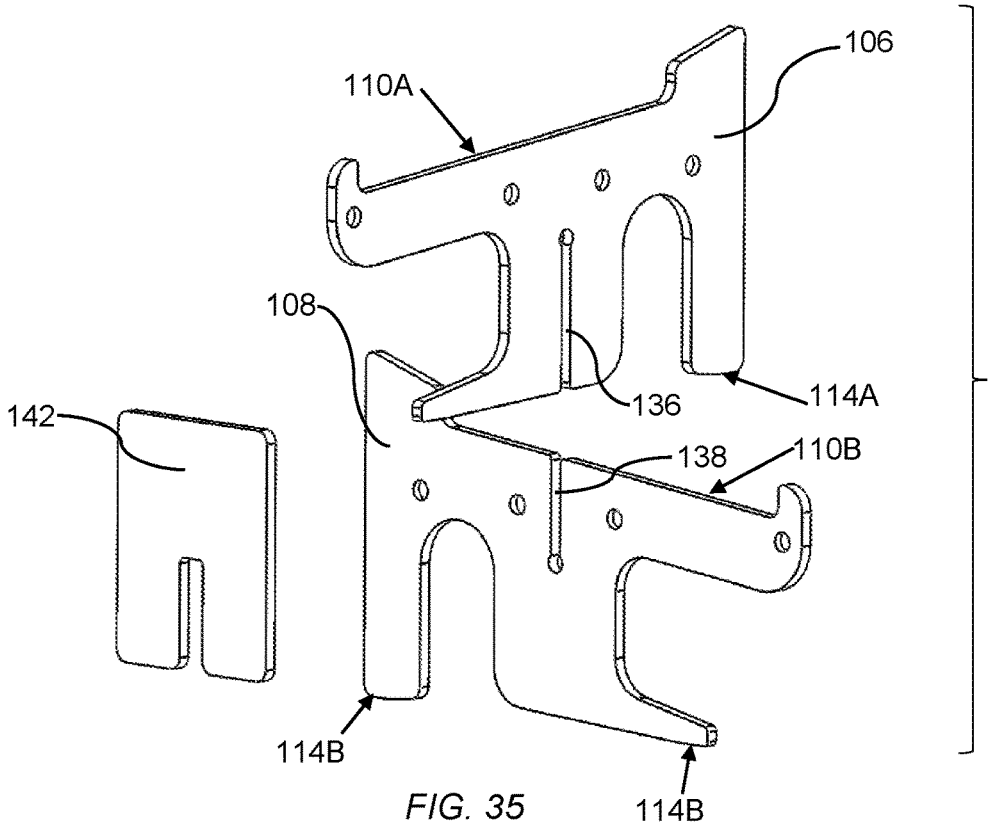
FIG. 35 illustrates, consistent with some embodiments, an exploded view of top and bottom piece showing assembly via interlocking of aligned slots (and recessed holes for magnets) and of how extender piece can be attached to side of bottom piece.

Moving forward to discuss further embodiments with reference to FIG. 35, in some embodiments the third edge 114A of the top piece 106 defines a first alignment slot 136 centered on the third edge 114A and extending approximately mid-way toward the first edge 110A of the top piece 106.

In some further embodiments, the first edge 110B of the bottom piece 108 defines a second alignment slot 138 centered on the first edge 110B and extending approximately mid-way toward the third edge 114B of the bottom piece 108.

Figure 1:
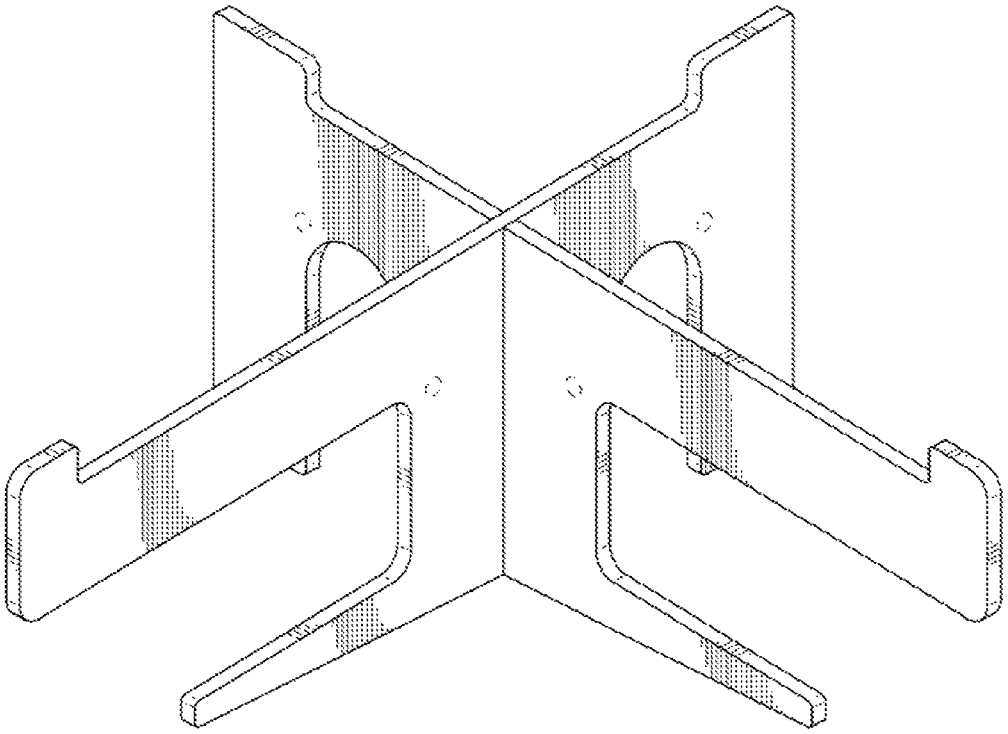
FIGS. 1-9 also show features and/or combination of features of the portable stand that are ornamental, the graceful lines and shapes of the edges.
Figure 2:
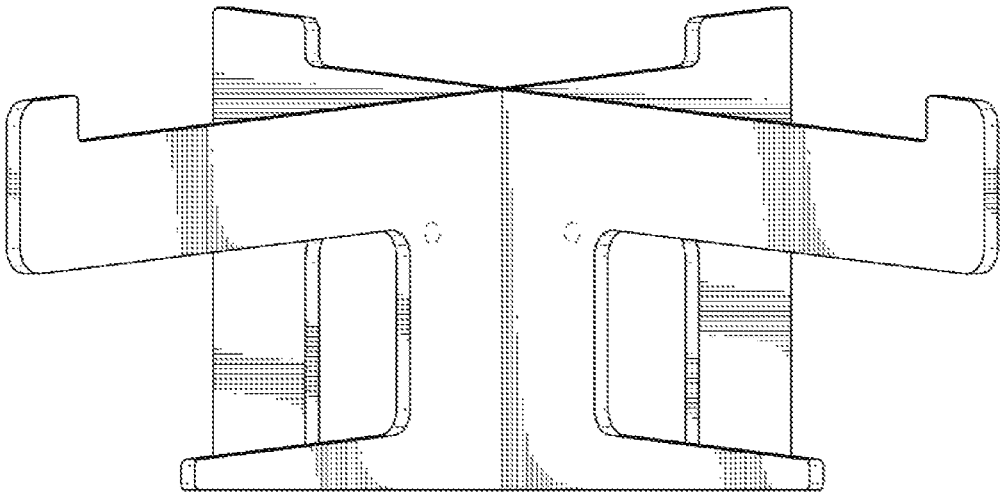
Figure 3:
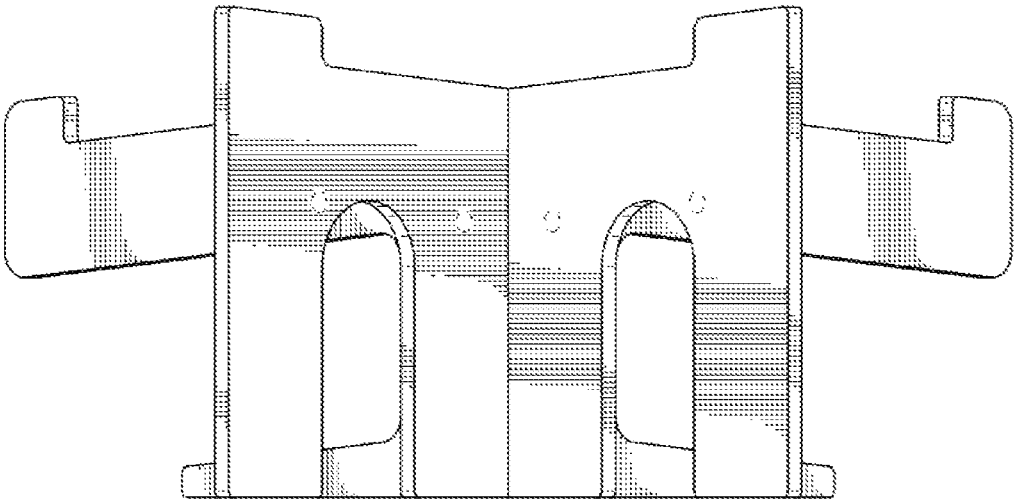
Figure 4:
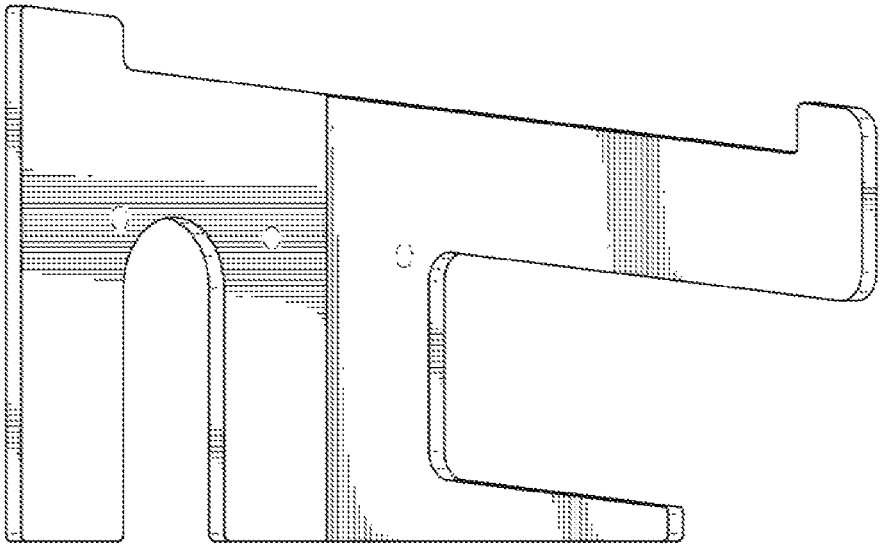
Figure 5:
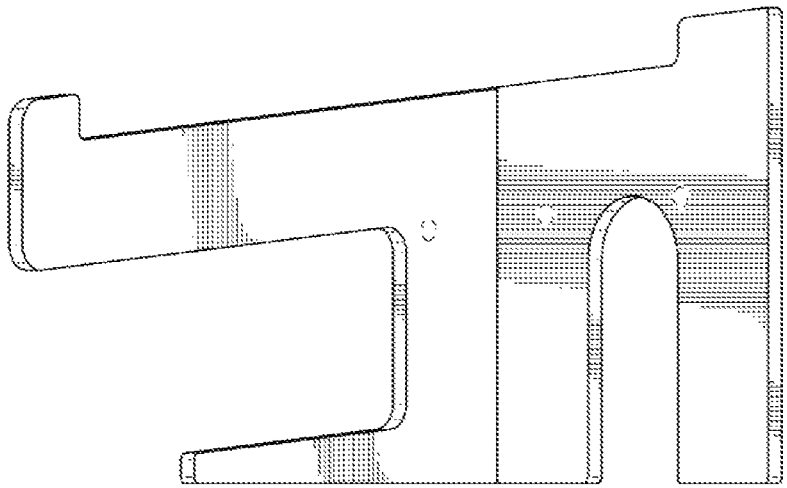
Figure 6:
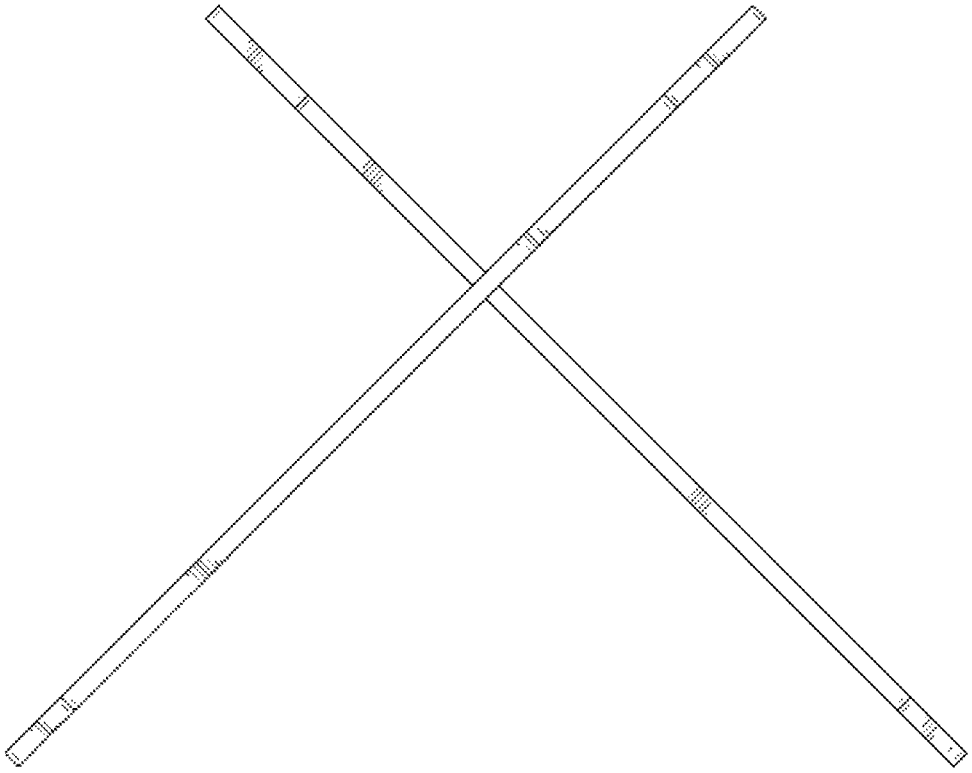
Figure 7:
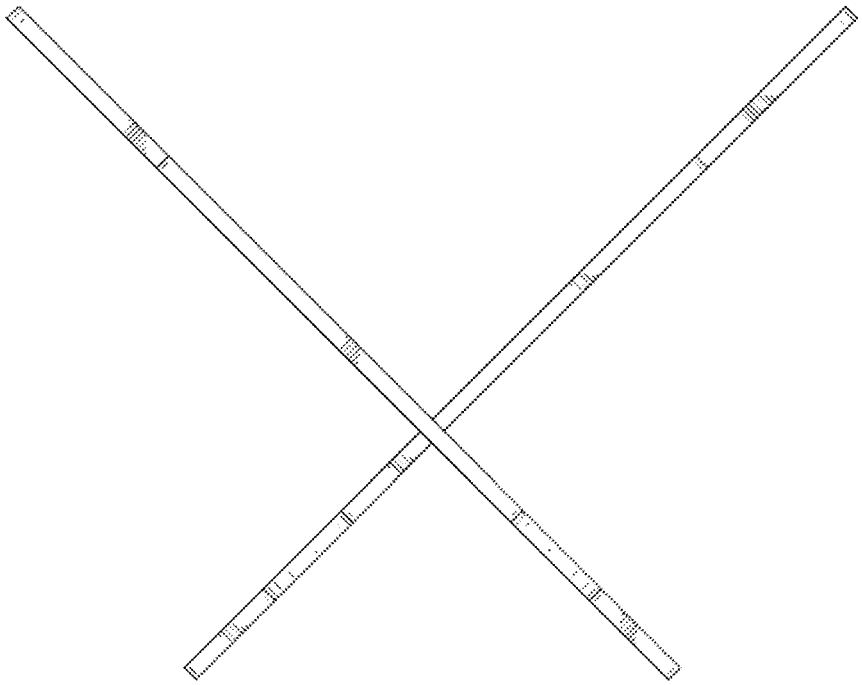
Figure 8:
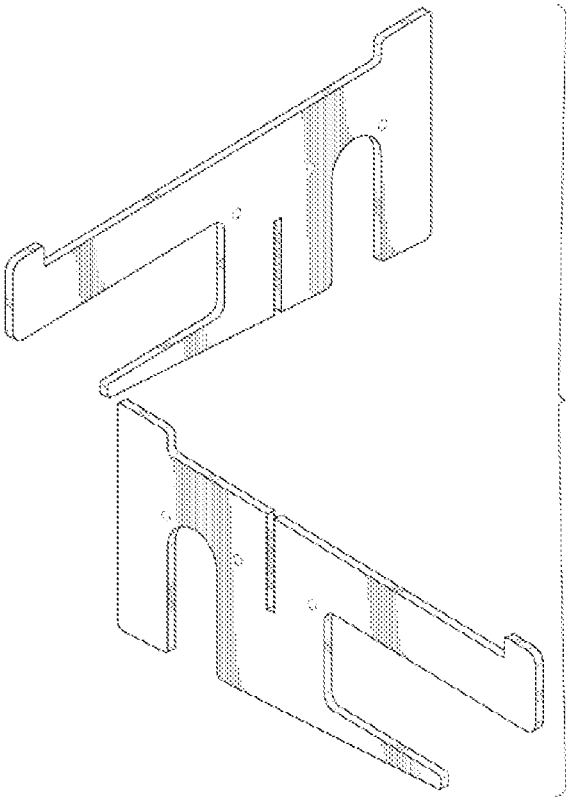

In some further embodiments, the top 106 and the bottom 108 pieces are configured to be interlocked to form the interlocking structure 118 (e.g., interlocking structure of FIGS. 9 and 36) by a mating of the first alignment slot 136 with the second alignment slot 138, the mated first and second alignment slots 136, 138, creating an intersection 140 (e.g., intersection 140 of FIGS. 14 and 36) of the top 106 and bottom 108 pieces that includes a center of the X shape (e.g., X shape 120 of FIG. 14) of the interlocking structure 118 (e.g., interlocking structure of FIGS. 9 and 36) (See also: FIG. 8).

Continuing to reference FIG. 35, in some embodiments, as shown in FIG. 35, the top 106 and bottom 108 pieces of the portable stand 100 are configured to be interlocked only via the mating of the first alignment slot 136 and the second alignment slot 138 and without of the use of fastening devices (e.g., clamps, rivets, nails, screws, elastic bands, hook and loop fasteners) separate from the top and bottom pieces.

Moving forward to discuss further embodiments with reference to FIGS. 9, 10 and 15, 16, and 28 in some embodiments the support structure 122 in the first position is defined by the intersecting first edges 110A, 110B of the top 106 and bottom 108 pieces. In some further embodiments the support structure 122 includes at least middle portions 174, 176 of the intersecting first edges 110A, 110B, respectively, including at least a middle portion 174 of the first edge 110A of the top piece 106 and a middle portion 176 of the first edge 110B of the bottom piece 108, the middle portions 174, 176 sized and configured for supporting at least a first portion 194 of a laptop 130.

In some further embodiments the support structure 122 includes at least first and second resting notches 178, 180 of the top piece 106 and the bottom piece 108 respectively, wherein the first edges 110A, 110B as they approach the fourth edges 116A, 116B protrude upward, relative to the flat surface 104, to define, adjacent to the respective middle portions 174, 176, the first resting notch 178 on the first edge 110A of the top piece 106 and the second resting notch 180 on the first edge 110B of the bottom piece 108 and wherein the two resting notches 178, 180 are positioned to prevent a laptop computer 130 (e.g., laptop computer 130 of FIGS. 15 (side-view), 16 (front view)) with a first portion 194 resting on the support structure 122 from sliding off of the support structure 122 as it slopes toward the front-side 124 (e.g., front side 124 of FIG. 10) of the interlocking structure 118.

Continuing to move forward to discuss further embodiments with respect to FIGS. 9, 10, and 15, in some further embodiments the support structure 122 further includes at least first and second resting slopes 190, 192 of the top piece 106 and the bottom piece 108 respectively, wherein the first edges 110A, 110B as they approach the second edges 112A, 112B protrude upward, relative to the flat surface 104, to define, adjacent to their respective middle portions, 174, 176, the first resting slope 190 on the first edge 110A of the top piece 106 and the second resting slope 192 on the first edge 110B of the bottom piece 108, wherein the first and second resting slopes 190, 192 are shaped to partially support a second portion 196 (e.g., second portion 196 of FIG. 15) of a laptop 130 while the first portion 194 of the laptop 130 is at least partly supported by the middle portions 174, 176. In some embodiments, the first portion 194 is also at least partly buttressed by the two resting notches 178, 180 (discussed above).

Figure 31:
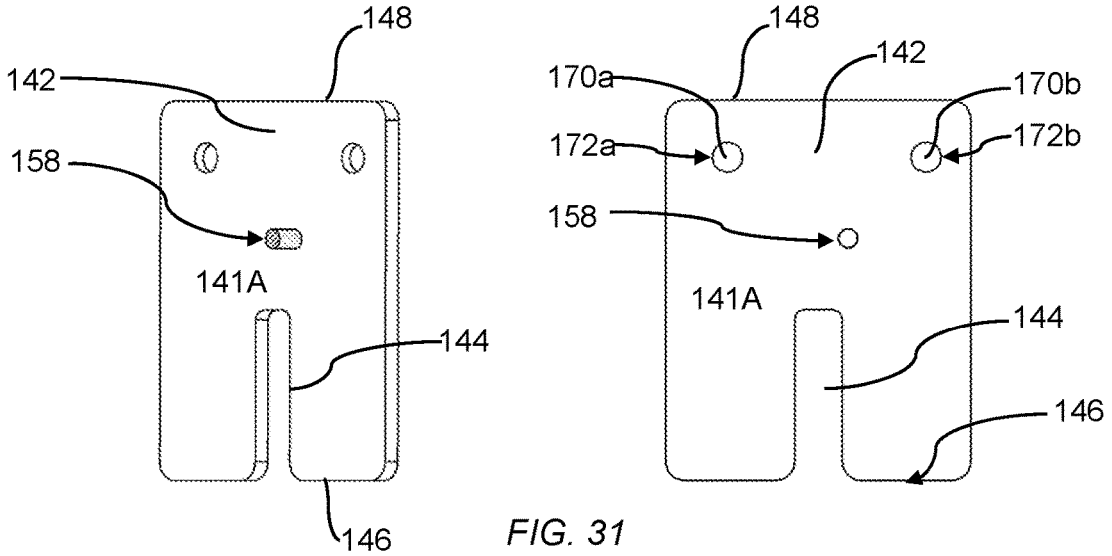
FIG. 31 illustrates, consistent with some embodiments, two views of an extender piece showing its shape and flat surface. A first view on the left is a perspective view of the extender piece showing a more three-dimensional view of the keeper pin and other features. A second view on the right is a two-dimensional view of the extender piece. These views show recessed features (holes) for magnets, an alignment keeper pin, and a notch for locating the extender piece on an intersection of the top and bottom pieces.

Moving forward to discuss further embodiments with reference to FIG. 31, in some embodiments a portable stand 100 further includes at least a panel-shaped extender piece 142 that includes an extender notch 144 that extends from an edge 146 of the extender piece 142 toward a top portion 148 of the extender piece 142 opposite the edge 146 of the extender piece 142.

Moving forward to discuss further embodiments with reference to FIGS. 13, 20, 21, and 31, in some embodiments the extender notch 144 is configured to slide over and mate the extender piece 142 to an intersection 140 (e.g., intersection 140 of FIG. 14) of first edges 110A, 110B of the top 106 and bottom 108 pieces when the interlocking structure 118 is in the first position. For example, in FIG. 13, extender piece 142 is shown attached to portable stand 100 at intersection 140. In some embodiments, when the extender piece 142 is mated to said intersection 140 the top portion 148 has a length (e.g., 4-10 inches) for raising the downward slope (e.g., of the support structure 122 and thus increasing a downward slope of a laptop computer 130 resting on the support structure 122. For example, in FIG. 20 a downward slope is illustrated by Angle E defined by Lines H2 (representing horizontal relative to flat surface 104) and Line L7. In some embodiments, Angle E is between 20 and 80 degrees relative to horizontal, with horizontal being parallel to the flat surface 104.

Figure 32:
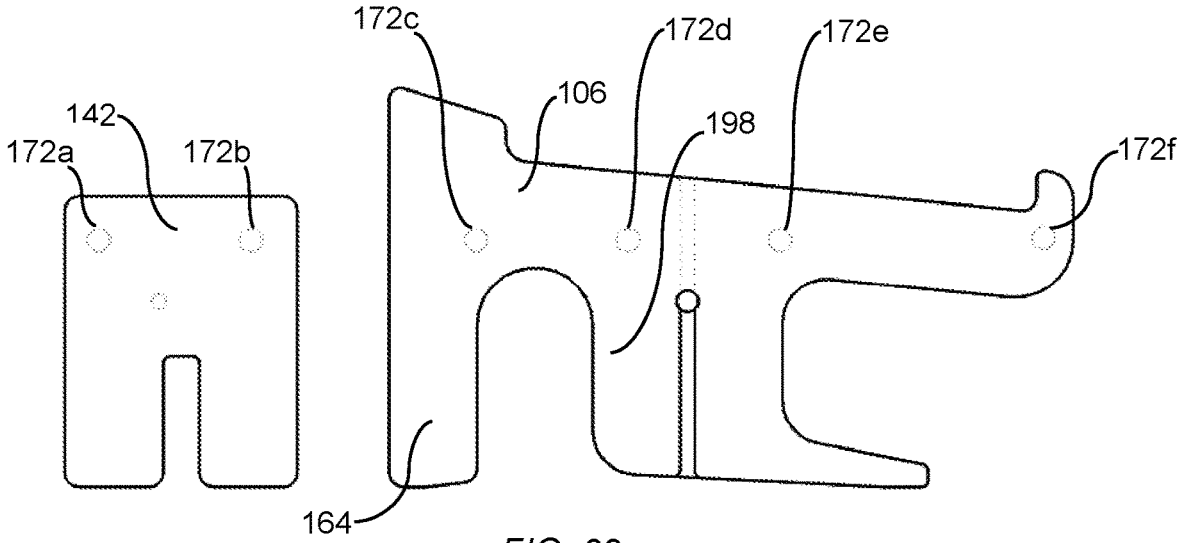
FIG. 32 illustrates, consistent with some embodiments, two-dimensional side views of an extender piece on the left and stacked top and bottom pieces on the right (only top piece visible). Further shows the top and bottom pieces stacked on top of each other (bottom piece not visible) and how their magnets line up to connect and hold them together. When the top and bottom pieces are lined up there is a circular cutout for the keeper pin to fit into. The faint gray lines show where the recesses magnets are. Note: the extender piece has magnets located to align and attach to the magnets in both the top and bottom pieces.

Moving forward to discuss further embodiments with reference to FIGS. 31, 32, 34, 36, 39, 41, in some further embodiments the extender piece 142 is configured to be detachably attached to a side (e.g., side 198 of top piece 106 of FIG. 32) of at least one of the top piece 106 or the bottom piece 108 for storage when not in use. Although FIG. 32 shows extender piece 142 as being capable of being detachably attached to side 198 of top piece 106, in other embodiments, extender piece 142 could be detachably attached to a side of a bottom piece.

In some further embodiments, further referencing FIG. 32, the extender piece 142 is configured to be detachably attached to the side (e.g., side 198 of top piece 106 of FIG. 32) of at least one of the top piece 106 or the bottom piece 108 at least partly via one or more magnets 172*a*, 172*b* attached to the extender piece aligning with one or more other magnets 172*c*, 172*d*, 172*e* attached to the side (e.g., side 198 of top piece 106 of FIG. 32) of at least one of the top piece 106 or the bottom piece 108.

Figure 25:
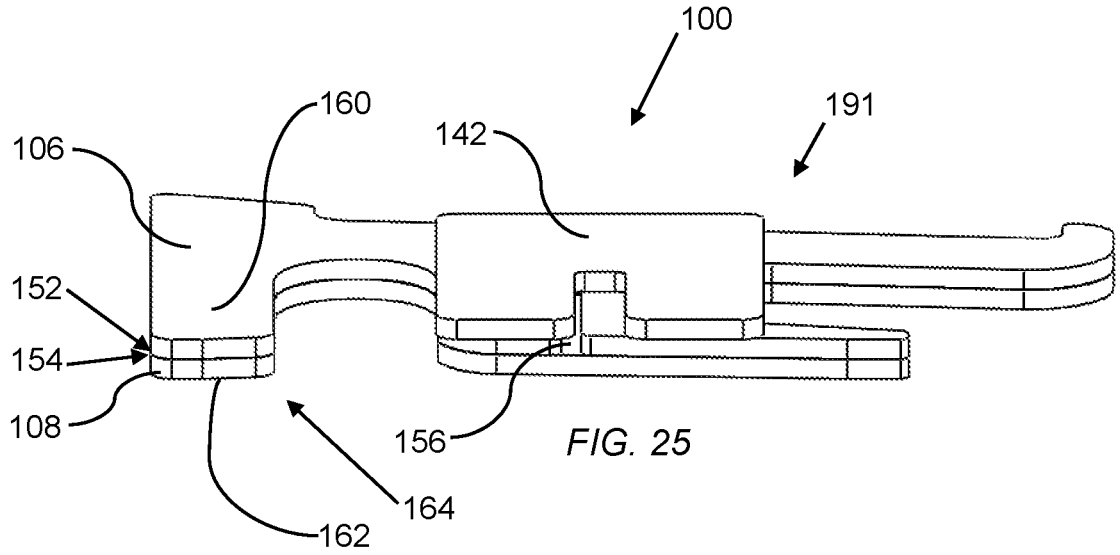
FIG. 25 illustrates, consistent with some embodiments, a perspective view of the portable stand of FIG. 9 disassembled and ready for transport, with extender piece, top piece and bottom piece in a stacked relationship.
Figure 27:
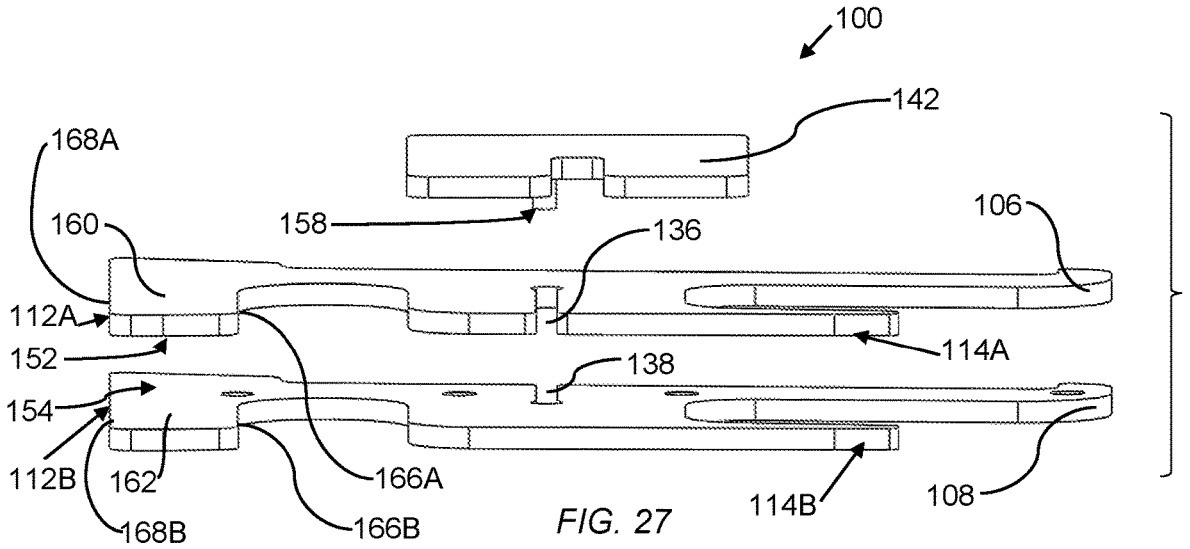
FIG. 27 illustrates, consistent with some embodiments, the pieces of FIGS. 25 and 26 in an exploded view of three main pieces that comprise the portable stand. Note: the keeper pin on the extender piece maintains all three shapes in alignment.
Figure 28:
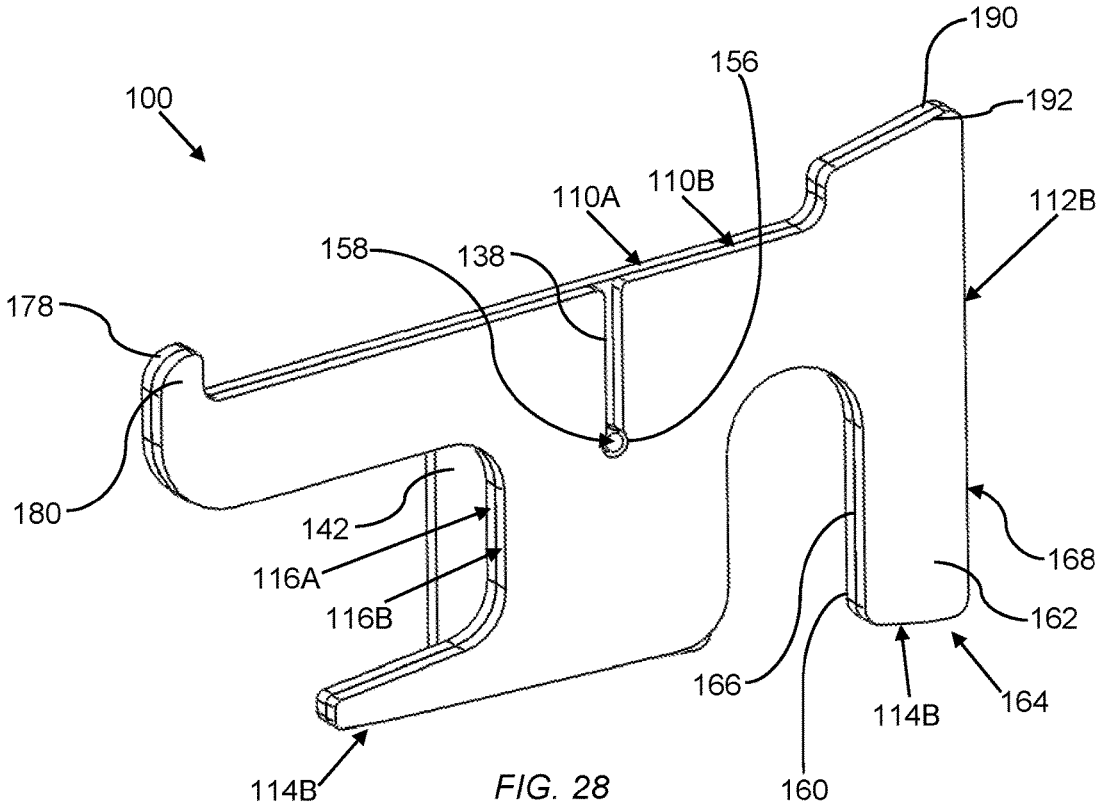
FIG. 28 illustrates, consistent with some embodiments, perspective view of the extender piece, the top piece, and the bottom piece ready for transport and kept in alignment by keeper pin.

Moving forward to discuss further embodiments with reference to FIGS. 25, 27, and 28 in some embodiments without consideration of the first and second alignment slots 136, 138, the top and bottom pieces 106, 108 are of substantially identical shape and size. And wherein when not interlocked to form the interlocking structure (e.g., 118 of FIG. 9), the top and bottom pieces 106, 108 are configured to be stacked along respective flat surfaces (e.g., flat surface 152 of top piece 106 and flat surface 154 of bottom piece 108).

Continuing to reference FIGS. 25, 27, and 28, in some embodiments the stacked top piece 106, and bottom piece 108 are configured to define a channel (see, e.g., keeper pin 158 inserted through channel 156 in FIG. 28) via overlap of the first alignment slot 136 of the top piece 106 and the second alignment slot 138 of the bottom piece 108.

As discussed above, e.g., relative to FIG. 31, in some embodiments a portable stand 100 (e.g., portable stand 100 of FIG. 9) further includes a panel-shaped extender piece 142 that includes an extender notch 144 that extends from an edge 146 of the extender piece 142 toward a top portion 148 of the extender piece 142 opposite the edge 146 of the extender piece 142. Continuing with reference to FIGS. 25, 27, and 28, in some embodiments the extender piece 142 is configured to be stacked on top of the top and bottom pieces 106, 108 when the top and bottom pieces 106, 108 are stacked along the respective flat surfaces 152, 154.

As discussed above, e.g., relative to FIG. 31, in some embodiments a portable stand 100 (e.g., portable stand 100 of FIG. 9) further includes a keeper pin 158 affixed to the extender piece 142. Continuing with reference to FIGS. 25, 27, and 28, in some embodiments the keeper pin 158 of the extender piece 142 is configured to fit into the channel 156 defined via overlap of the first alignment slot 136 of the top piece 106 and the second alignment slot 138 of the bottom piece 108. And when the keeper pin 158 is so positioned within the channel 156, the extender piece 142 is thereby stacked on top of the stacked top and bottom pieces 106, 108 with the keeper pin 158 preventing sliding or shearing of the pieces relative to one another. As noted, in some embodiments, channel 156 is defined as an overlap of alignment slots 136, 138 (alignment slot 136 not visible in FIG. 28) of the top and bottom pieces 106, 108. In some particular embodiments, interior ends of the alignment slots 136, 138 are enlarged to form circular cutouts (e.g., 155A and 155B of FIGS. 29 and 30 and 155A of FIG. 32) that then form channel 156 when they overlap. When channels 156 are in the shape of circular cutouts 155A, 155B they more naturally fit around a diameter of keeper pin 158.

Moving forward to discuss further embodiments with reference to FIGS. 25, 26, 27, and 28, in some embodiments when the extender piece 142, the top piece 106, and the bottom piece 108 are in this stacked position, a protrusion 160 defined by the top piece 106 and a substantially identical protrusion 162 defined by the bottom piece 108 collectively provide a handle 164 for carrying the stacked structures (e.g., collectively pieces 142, 106, 108), the two protrusions 160, 162 each having a first side (e.g., side 166A of the top piece, side 166B of the bottom piece) defined by the respective third edges 114A, 114B of the top and bottom pieces 106, 108 that provides a wall of the e-reader slot (e.g., e-reader slot 128 of FIG. 12) and a second side (e.g., side 168A of the top piece 106 and 168B of the bottom piece 108) that is formed by the respective second edges 112A, 112B of the top and bottom pieces 106, 108.

Figure 26:
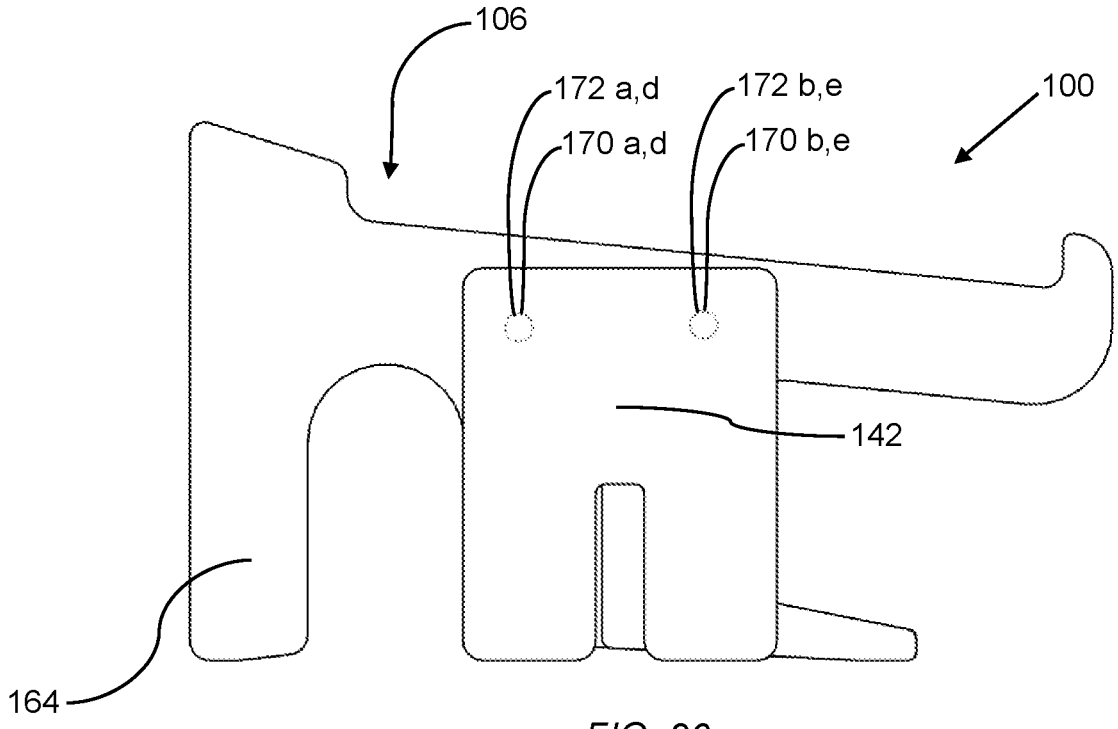
FIG. 26 illustrates, consistent with some embodiments, a top view of what is shown in FIG. 25, that is the portable stand of FIG. 9 disassembled and ready for transport.
Figure 29:
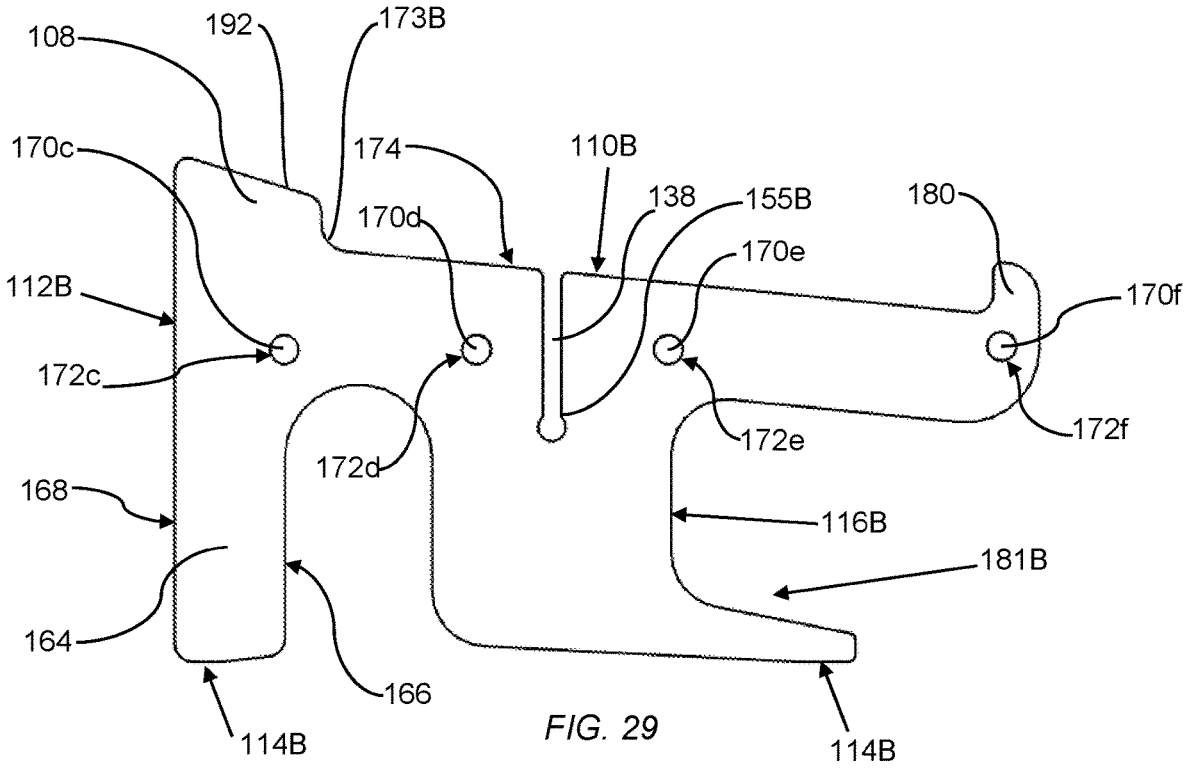
FIG. 29 illustrates, consistent with some embodiments, a side view of a bottom piece showing its shape and flat surface. This drawing outlines some features of the bottom piece: Recessed features (holes) for magnets, shape features for handle and portable keyboard, a slot for alignment with the top piece, a circular cut-out for keeper pin alignment, and a feature for keeping portable electronic devices on the portable stand.
Figure 30:
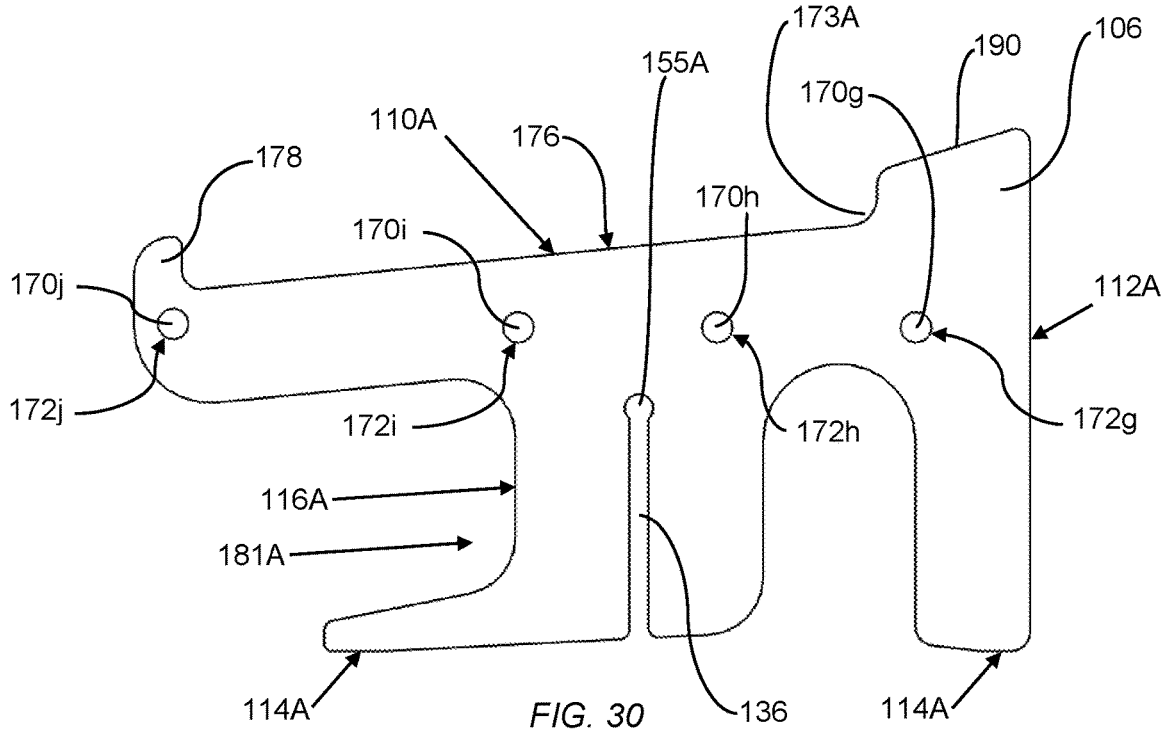
FIG. 30 illustrates, consistent with some embodiments, a side view of a top piece showing its shape and flat surface. This drawing outlines some features of the top piece: Recessed features (holes) for magnets, shape features for handle and portable keyboard, a slot for alignment with the top piece, a circular cut-out for keeper pin alignment, and a feature for keeping portable electronic devices on the portable stand.

Referencing FIGS. 26, 29, and 30, in some embodiments a portable stand 100 (e.g., portable stand 100 of FIG. 9) further includes at least a plurality of magnets 172*a*-172*j* attached to the extender piece 142 (e.g., magnets 172*a-b*), the top piece 106 (e.g., magnets 172*g-j*), and the bottom piece 108 (e.g., magnets 172*c-f*), wherein the attached plurality of magnets 172*a*-172*j* are positioned and aligned to at least partly secure the extender piece 142, the top piece 106, and the bottom piece 108 to one another and thereby prevent sliding or shearing of the pieces relative to one another.

Continuing with reference to FIGS. 26, 29, and 30, in some embodiments the plurality of magnets 172*a*-172*j* are positioned and aligned by being disposed within corresponding and strategically placed holes 170*a*-170*j* that extend at least partly through sides of the extender piece 142 (e.g., with holes 170*a-b*), the top piece 106 (e.g., with holes 170*c-f*), and the bottom piece 108 (e.g., with holes 170*g-j*).

Returning to discuss portable stand 100 of FIGS. 9 and 15 in some embodiments the support structure 122 in the first position is configured to hold a laptop 130 between 4 and 11 inches above the flat surface 104 for ergonomic reading by user (not shown) (e.g., user facing front side 124 of interlocking structure 118) sitting in front of a desk (not shown).

Moving forward with reference to FIGS. 39-42, in some embodiments a portable stand 100 includes at least an interlocking structure 118, wherein when the interlocking structure 118 is in the first position, the tablet slot 126 defined by the fourth edges 116A, 116B, is configured to be a recessed area 182 for receiving and supporting at least a rear portion 186 of a keyboard 184 while a front portion 188 of the keyboard 184 is supported by the flat surface 104, wherein the rear portion 186 of the keyboard 184 is the portion furthest from a user (not shown) (e.g., facing front side 124 of interlocking structure 118) while in use and the front portion 188 of the keyboard 184 is the portion that is closest to a user while in use. In some embodiments when the rear portion 186 of the keyboard 184 is supported by the tablet slot 126 and the front portion 188 of the keyboard 184 is supported by the flat surface 104, the keyboard slopes downward toward a user (not shown) (e.g., facing front side 124 of interlocking structure 118) in front of the front-side 124 interlocking structure 118 at an angle between 5 and 15 degrees below horizontal relative to the flat surface (e.g., Angle F of FIG. 41 defined by flat surface 104 and Line L8).

As a caveat, it is noted that recessed area 182, above, may also be viewed as formed by "recessed area for portable keyboard" 181A, 181B, of top and bottom pieces 106, 108, respectively, as discussed below relative to FIGS. 29 and 30. Areas 181A, 181B are part of edges 116A, 116B discussed above.

Figure 18:
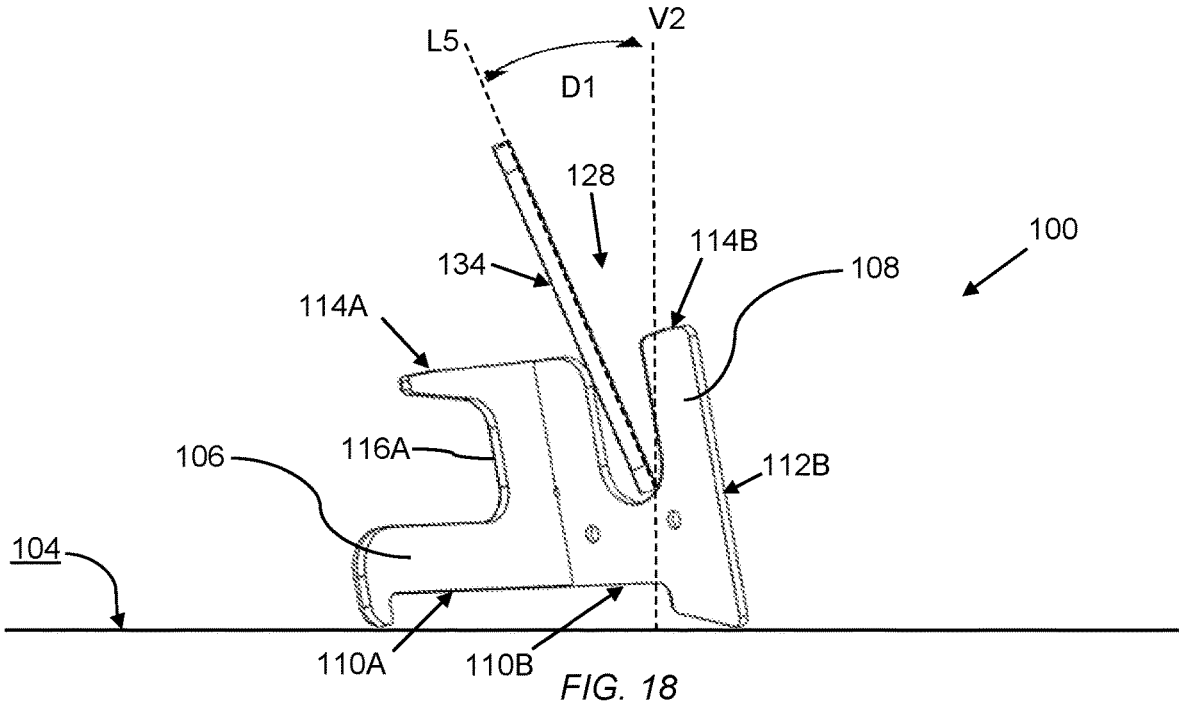
FIG. 18 illustrates, consistent with some embodiments, a side view of the portable stand of FIG. 9 in position three supporting an e-reader in its e-reader slot.

Moving forward with reference to FIG. 18, in some embodiments when an interlocking structure 118 is in the third position an e-reader slot 128 is sized and configured for holding an e-reader 134 in an orientation between 0 and 45 degrees (e.g., where Angle D1 defined by Lines L5 and V2 is between 0 and 45 degrees) of vertical (e.g., as represented by Line V2) relative to the flat surface 104.

Figure 19:
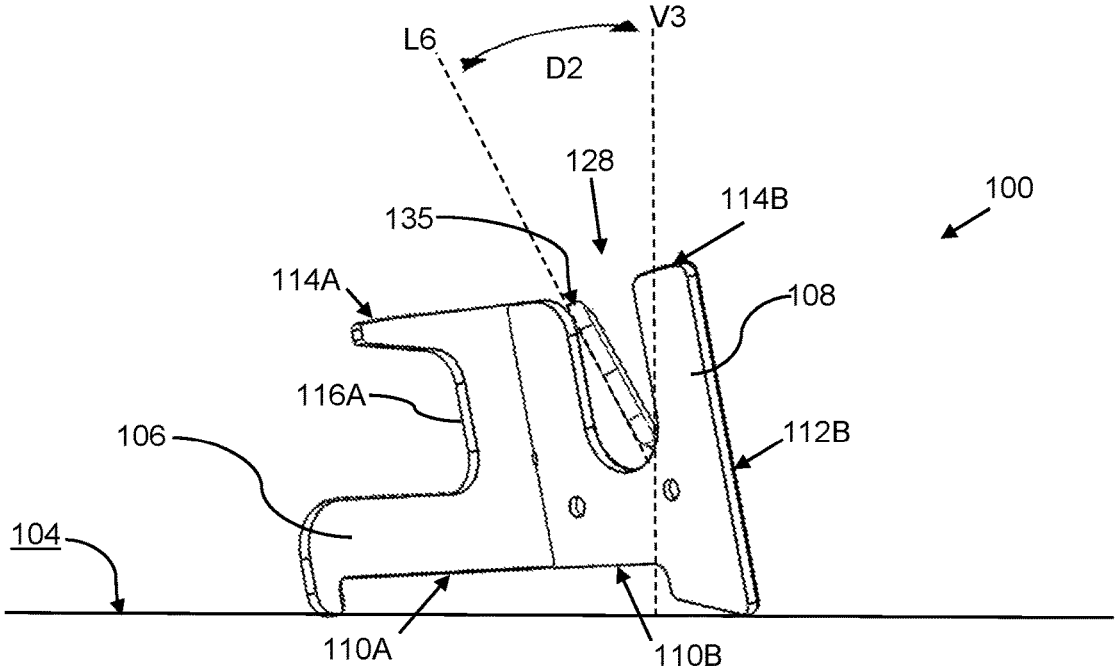
FIG. 19 illustrates, consistent with some embodiments, a side view of the portable stand of FIG. 9 in position three supporting a smartphone in a landscape or horizontal orientation in its e-reader slot.
Figure 20:
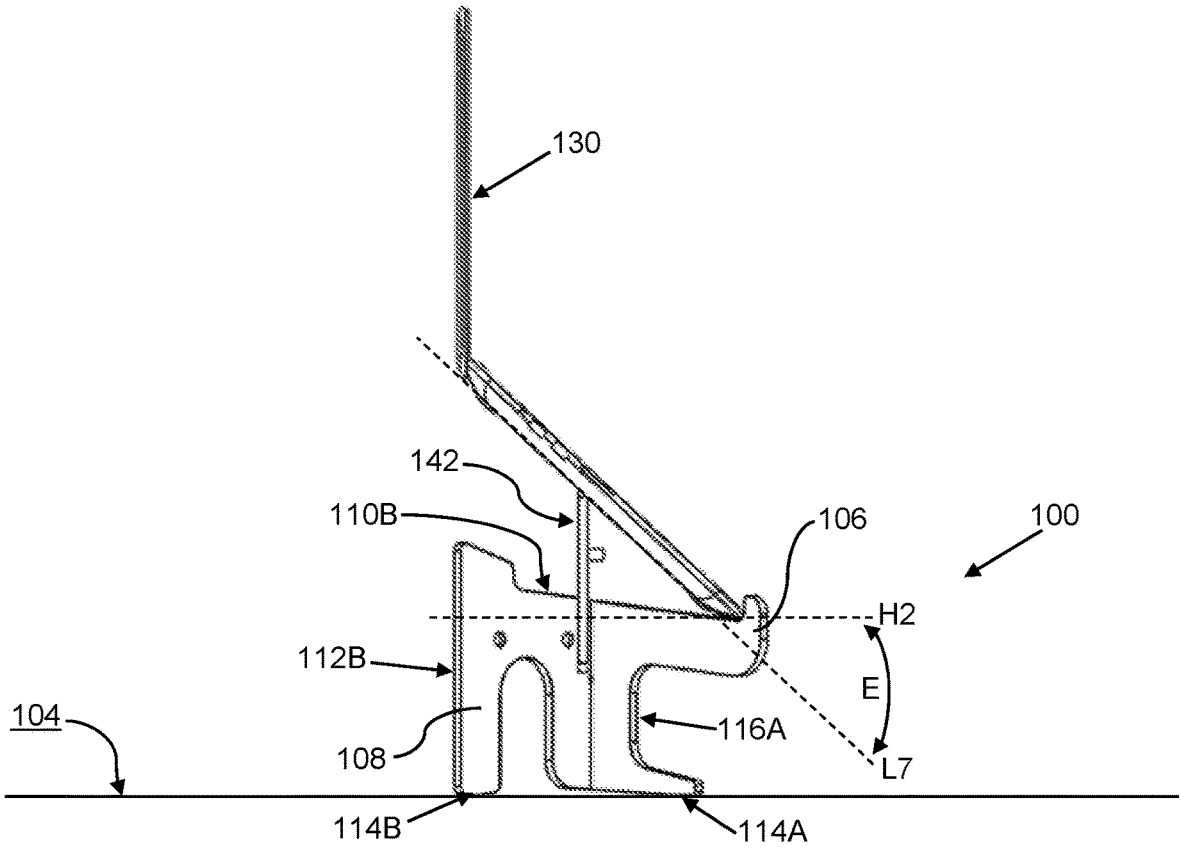
FIG. 20 illustrates, consistent with some embodiments, similar to FIG. 13, a side view of the portable stand of FIG. 9 in position one with an extender piece attached to the interlocking structure, but with a laptop computer supported on the extender piece and on the supporting structure.
Figure 21:
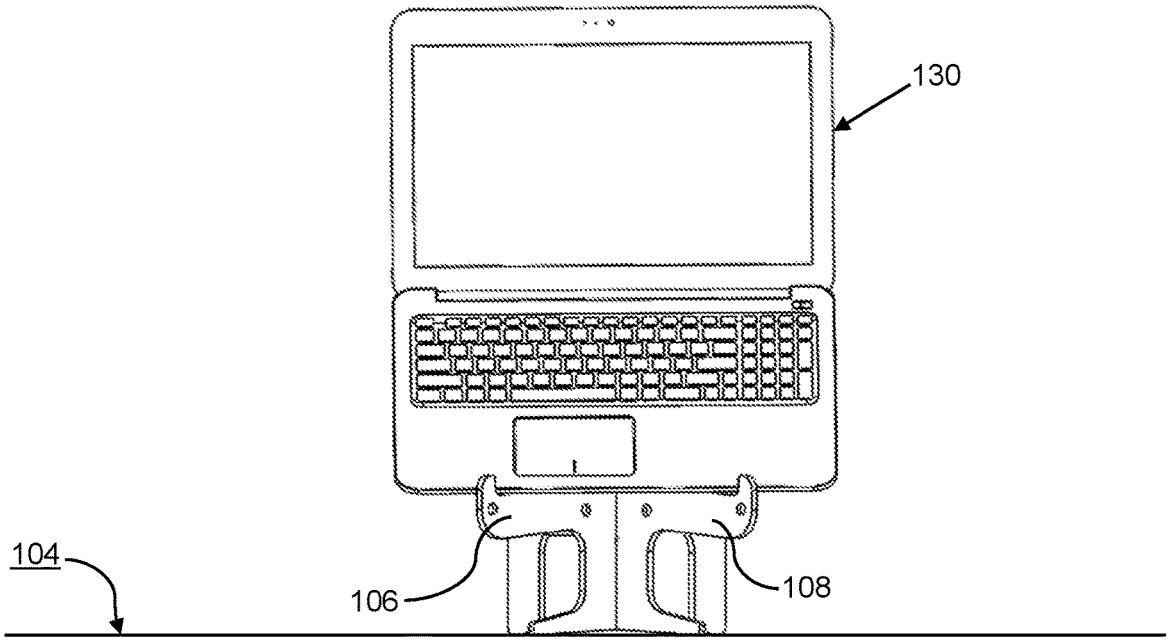
FIG. 21 illustrates, consistent with some embodiments, a front view of the portable stand and laptop computer of FIG. 20 with an extender piece attached to the interlocking structure, but with a laptop computer supported on the extender piece and on the supporting structure (supporting structure and extender piece not visible).

In addition, in some embodiments, referencing FIG. 19, when an interlocking structure 118 is in the third position an e-reader slot 128 is sized and configured for holding a smart phone 135 in an orientation between 0 and 45 degrees (e.g., where Angle D2 defined by Lines L6 and V3 is between 0 and 45 degrees) of vertical (e.g., as represented by Line V3) relative to the flat surface 104.

As discussed above, the present disclosure generally describes some embodiments of a portable stand for use in positioning a portable electronic device, at, or near, eye level when resting on a support surface such as a table or desk. The portable stand is useful with portable electronic devices including laptop computers, tablets, e-readers, and other small, transportable consumer electronics. When placed on a flat surface (such as a desk or table) the portable stand may position the screen of said portable electronic device at various elevations that are higher than what would otherwise be achieved if the portable electronic device was resting directly on said flat surface (such as a desk or table). When not in use, in some embodiments, the portable stand may be assembled in a compact configuration for ease in transport and storage.

As discussed above, in some embodiments the stand may be portable, such that it can be taken to different locations for remote use away from home or office. Being easily portable, in these embodiments the stand may allow the user to maintain an ergonomic working posture and reduce repetitive use injuries that may be common with remote work environments when using portable electronic devices. In addition, the design of the portable stand allows for the integration of a portable keyboard to maintain proper hand/arm position while typing, to again, potentially reduce repetitive use injuries.

Again, as discussed above, in some embodiments a portable stand 100 includes at least three elements or pieces. Specifically, they are a top piece 106, a bottom piece 108, and an extender piece 142. In various embodiments these pieces may be constructed of many rigid materials, including at least one of wood, plastic, metal, or laminations of at least one of wood, plastic, or metal. The three panel shapes, consistent with some embodiments, may be cut out by various mechanical means, one example being a CNC router. The panel shapes may be cut and magnet insert holes may also be cut and/or machined partially through the panel shapes at the appropriate locations. Once the shape have be cut, additional sanding and finishing steps may be carried out as well as insertion of the magnets and keeper pin.

Of the three panel shapes, the top and bottom pieces 106, 108 are of similar shape and size. In some embodiments they may range from 10 to 16 inches in length while the width may vary from 4 to 10 inches. In some embodiments, the third panel pieces, the extender, may vary from 4 to 8 inches in length while the width may vary from 3 to 8 inches. In some embodiments the thickness of all three panels may vary from ⅛ inch up to 1 inch. For some embodiments the cut-out (in top and bottom pieces) for the tablet slot is 1.5 times the width of the e-reader slot cutout, for example 3 inches vs 2 inches. In some embodiments they may both be of comparable depth compared to each other, for example, between 4 and 5 inches—from a cutout point of view. For some embodiments, the top and bottom pieces 106, 108, are cut out so that the tablet slot holds a tablet computer twice as high above the flat surface 104 than the e-reader slot, in one example 5 inches vs 2.5 inches. In some embodiments, they both hold a device of minimum width 4 to 5 inches wide. All of the above dimensions are examples only and are applicable to specific embodiments. In some other embodiments different dimensions from those discussed above may be used.

These pieces can be assembled in one configuration (e.g., first position discussed above), to support a portable electronic device, for example, a laptop, at or near eye level. They can be assembled in a second configuration (e.g., with extender piece attached while in first position) to give additional height to the portable electronic device when it may be required or useful. In addition, the pieces may be assembled in a compact manner that holds them together and makes them easily portable.

FIG. 25 illustrates a perspective view and example of the three main components stacked together and assembled for transport, consistent with some embodiments. When in this configuration, the three pieces 106, 108, 142 may form a shape 191 that is compact and may have a handle 164 built into the design for ease in gripping and transport as seen in FIG. 26. The main components in this example may stack onto each other and be located and held in place by a keeper pin 158 as seen if FIG. 27. FIG. 28 illustrates how, in some embodiments, the keeper pin 158 may align within the overlapping 'Circular cutouts' (a specific embodiment of channel 156). In some embodiments, channel 156 is defined as an overlap of alignment slots 136, 138 (alignment slot 136 not visible in FIG. 28) of the top and bottom pieces 106, 108. In some particular embodiments, interior ends of the alignment slots 136, 138 are enlarged to form circular cutouts (e.g., 155A and 155B of FIGS. 29 and 30) that then form channel 156 when they overlap. Channels 156 in shape of circular cutouts 155A, 155B more naturally fit around a diameter of keeper pin 158.

In some embodiments the keeper pin 158 may be sized such that it extends fully through a thickness of the top piece 106 and at least partially through a depth (thickness) of the bottom piece 108. This feature, or something similar, may locate the main pieces of this invention and prevent them from sheering away from each other during storage or transport.

FIGS. 29 and 30, consistent with some embodiments, show details of various features of a bottom piece (FIG. 29) and a top piece (FIG. 30). The top and bottom pieces 106, 108 of the portable stand 100 may be held together for transport via the keeper pin 158 (e.g., keeper pin 158 of FIG. 27) that is part of the extender piece 142 (e.g., extender piece 142 of FIG. 27) in addition to magnets (e.g., magnets 172*c*-172*f* of bottom piece 108 of FIG. 29 and magnets 172*g*-172*j* of top piece 106 of FIG. 30) that have been located within the recessed holes (e.g., holes 170*c*-170*f* of bottom piece 108 of FIG. 29 and magnets 170*g*-170*j* of top piece 106 of FIG. 30) as shown in FIGS. 29 and 30. These magnets 172*c*-172*j* (or other means or devices) serve to keep the 'top, bottom, and extender pieces 106, 108, 142 together for storage and transport.

Consistent with some embodiments, FIGS. 29 and 30 also show a slot for stand assembly (e.g., alignment slots 136, 138) that is used to align the top and bottom pieces 106, 108 so that they may be assembled to support a portable electronic device. Also detailed in FIGS. 29 and 30 is a circular cutout (e.g. circular cutouts 155A, 155B, discussed above) feature that may allow for alignment with the keeper pin 158 of the extender piece 142. FIGS. 29 and 30 also show the 'Handle' feature 164 that is part of the shape of the top and bottom pieces 106, 108, that when they are stacked on top of each other as shown in FIG. 25, they form a handle 164 for use in transport.

In addition, consistent with some embodiments, FIGS. 29 and 30 show a 'Recessed area for portable keyboard' 181A, 181B, that collectively define recessed area 182 (e.g., see above discussion of recessed area 182 relative to FIGS. 39-42). This feature may be designed into the shape of the top and bottom pieces 106, 108 such that a portable keyboard 184 can be supported on the sloped area for support and ease of typing. The recessed area 181A, 181B and shape of the portable stand may allow a portable keyboard 184 to be located on a flat surface 104, such as a table or desk while the portable stand raises the screen of the portable electronic device to at, or near eye level. In addition, there are other possible configurations of some embodiments that may not contain the 'Recessed area for portable keyboard' (See, e.g., FIGS. 43, 44).

Consistent with some embodiments, FIGS. 29 and 30 also show 'Resting notch for portable electronic device' (e.g., resting notches 179 and 180). This feature may provide a means to locate and maintain the portable electronic device on top of the portable stand in some embodiments. The resting notch height may be such as to locate and maintain the perch of wide range of portable electronic devices. The height and shape of the resting notch presented in FIGS. 29 and 30 are examples of one possible variation.

Consistent with some embodiments, also shown in FIGS. 29 and 30 is 'Recessed areas for better fit' 173A, 173B (respectively of top and bottom pieces 106, 108). This feature may provide for a reduced number of contact points between the portable stand and portable electronic devices allowing for a wider range and variety of portable electronic devices that may reside on the stand. In addition, this recessed area 173A, 173B and fewer contact points facilitate better airflow and cooling of portable electronic devices.

Consistent with some embodiments, FIGS. 29 and 30 also contain a feature of 'Top resting slopes for electronic devices' 190, 192 (respectively of top and bottom pieces 106, 108). This feature provides for the top locating point and promotes one of the slopes of use for the portable electronic device. The height of this top point and slope may be useful in providing a work angle and height of screen for the user. In addition, mechanical means may be added to improve adhesion and grip of the pieces to a support structure by attaching to bottoms of the top and bottom pieces 106, 108 as well as grip means to the 'Recessed area for portable keyboard' (e.g., 181A, 181B discussed above) and 'Resting notch for portable electronic device' (e.g., 178, 180 discussed above). In general, additional means may be added to improve grip and adhesion of these pieces to the support structure and portable electronic device. One possible example may be a rubberized adhesive strip but many options of grip or non-slip are available.

Consistent with some embodiments, FIG. 31 illustrates, consistent with some embodiments, two views of an extender piece showing its shape and flat surface. A first view on the left is a perspective view of the extender piece showing a more three-dimensional view of the keeper pin and other features. A second view on the right is a two-dimensional view of the extender piece. In some embodiments, this stand component (extender piece 142) may serve several roles for a portable stand. By use of a keeper pin 158 or some other means, in addition to the magnets 172*a*, 172*b* fit into the 'Recessed holes for magnets' 170*a*, 170*b*, this extender piece 142 may be used to locate and keep the other two components top piece 106 and bottom piece 108 together and aligned for transport and storage. When not used for transport, the extender piece 142 may be attached to the other two assembled pieces (i.e., top and bottom pieces 106, 108) via the 'Extender notch' 144 at the intersection (e.g., intersection 140 of FIG. 14) of the top and bottom pieces 106, 108 to raise a portable electronic device to another height at, or near, eye level (See FIGS. 37 and 40 for possible examples). This additional height option allows the user to have several heights for use of a portable electronic device. The extender piece 142 in position at the intersection (e.g., intersection 140 of FIG. 14) of the top and bottom pieces 106, 108 also shifts the center of gravity forward for portable electronic devices. This may add stability to larger devices.

Figure 33:
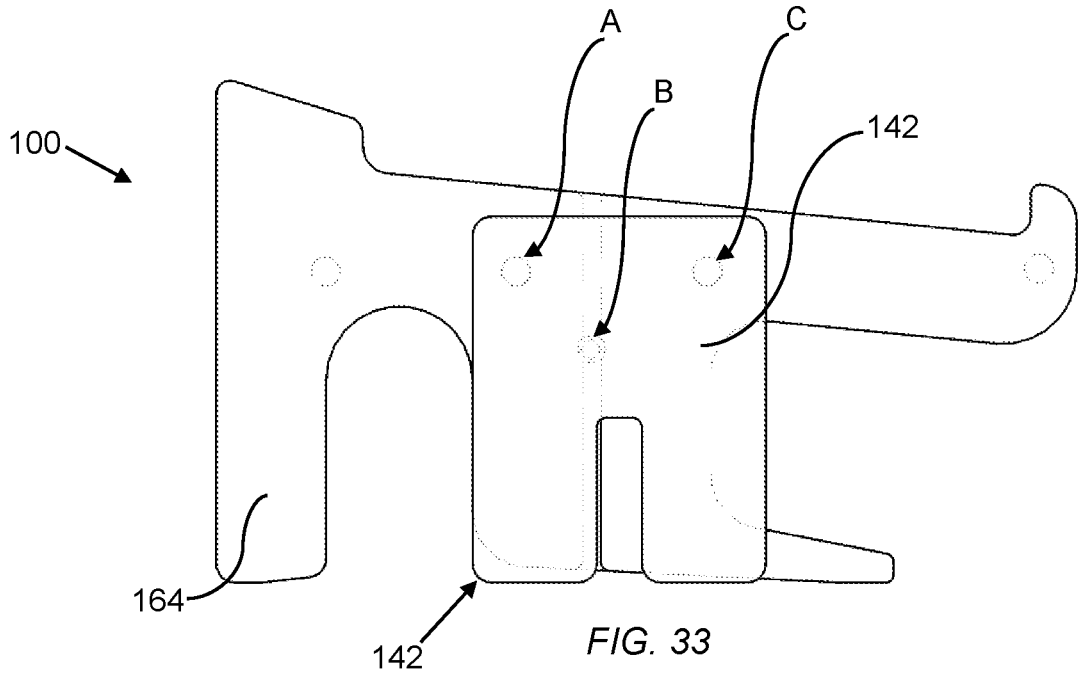
FIG. 33 illustrates, consistent with some embodiments, a side view of an extender piece, top piece, and bottom piece stacked together (bottom piece not visible). Note in this position the keeper pin (not visible) aligns with the circular cut out holes (not visible) in the top and bottom pieces. This coupled with the magnets in each part keeps them from shearing apart while transported.
Figure 34:
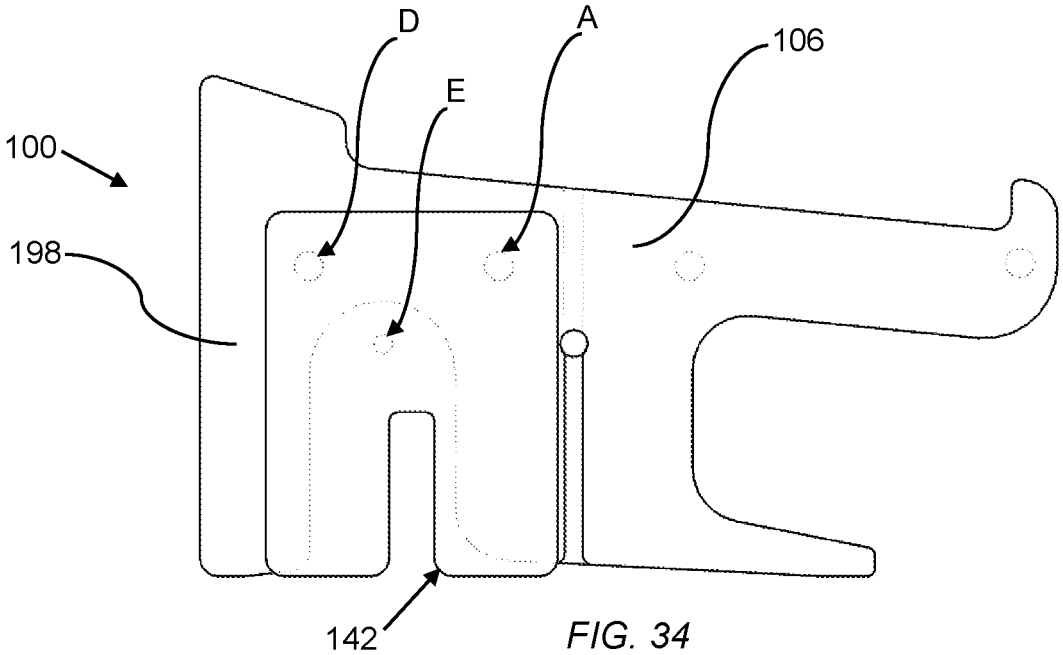
FIG. 34 illustrates, consistent with some embodiments, a side view of extender piece stored on the side of a top piece while not in use, including showing how the magnets (shown in dotted line) are spaced so that the extender piece can be held on the side with magnets while not in the extender position. Also shows how while in this side stored position, the keeper pin (shown in dotted line) fits within the cutout arch (shown in dotted line) and does not interfere with the other piece.

Consistent with some embodiments, FIGS. 32, 33, and 34 show different configurations of a portable stand 100 with extender piece 142. In FIG. 32, a top piece 106 is stacked over a bottom piece (not viewable) with the extender piece 142 off to the side. Magnets (172*a*, 172*b* of extender piece 142 and 172*c*, 172*d*, 172*e*, and 172*f* of top piece 106) ease assembly. Additional magnets in bottom piece 108 are not shown but are arranged to align with those of top piece 106. The magnets align in the top and bottom pieces 106, 108 to assist in holding them together when not set up. The magnet hole spacing is such that the magnets 172*a*, 172*b* in the extender piece 142 may align with the magnets in the top and bottom pieces 106, 108, holding all three pieces together. In addition the magnet hole spacing allows the extender piece 142 to be held vertically to the side when the top and bottom pieces 106, 108 are assembled and the extender piece 142 is not needed (See FIGS. 34 and 36). The magnet holes may be recessed or go through the pieces entirely.

Consistent with some embodiments, FIG. 33 shows the extender piece 142 located on top of the stacked top and bottom pieces 106, 108. The magnets of all three components line up at locations A and C to hold the three pieces together. This may be accomplished by other alignment or mechanical means. In addition, the keeper pin 158 (e.g., keeper pin 158 of FIG. 27) in the extender piece 142 aligns with the 'Circular cutouts' (e.g., 155A and 155B of FIGS. 29 and 30) in at location B keeping all three pieces together with stored in this manner.

Consistent with some embodiments, FIG. 34 shows extender piece 142 stored on a side 198 of top piece 106. In particular, FIG. 34 shows, consistent with some embodiments, how the magnet spacing aligns and works for the extender piece 142 to be held in place with magnets and locations D and A while the keeper pin 158 stores at location E without interfering with the surrounding structure and can be stored on the side 198 (See FIG. 36).

Consistent with some embodiments, FIG. 35 shows how the top and bottom pieces 106, 108 may be joined by aligning their respective alignment slots 136, 138 and sliding them onto each other (extender piece 142 depicted to one side). This is only one mechanical means, and example, of joining these pieces and the function of joining the two pieces may be accomplished by other means.

Figure 36:
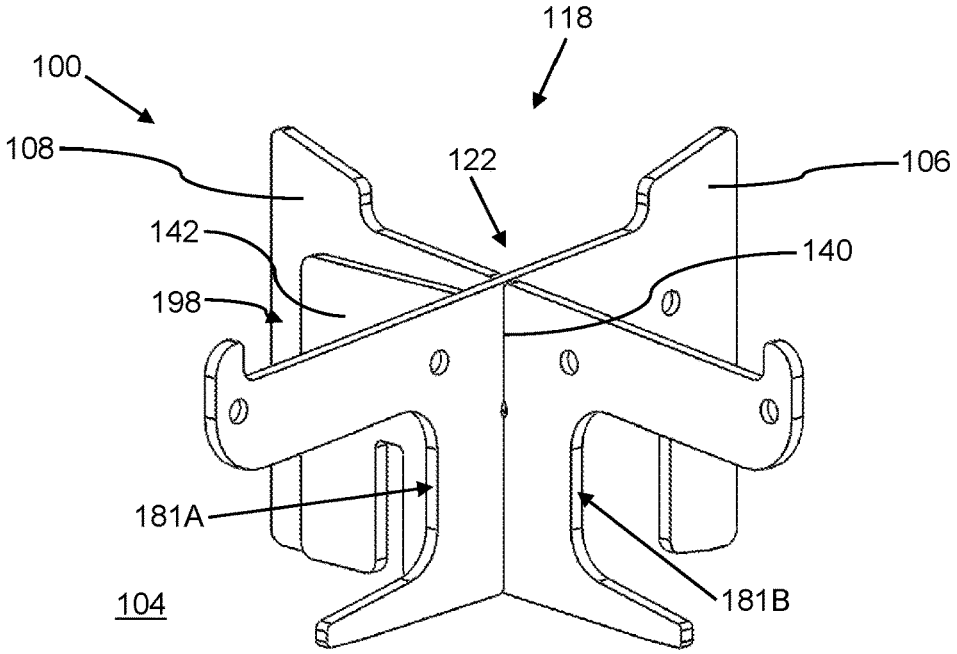
FIG. 36 illustrates, consistent with some embodiments, a perspective view of assembled portable stand with extender piece on the side.

Consistent with some embodiments, FIG. 36 shows one embodiment of the portable stand assembled and ready to support an electronic device. In this configuration, the extender piece 142 is stored vertically on the side, held in place by magnets or other means (see above discussion with reference to FIGS. 32-34). The portable stand 100 is assembled into an interlocking structure 118 by the top and bottom pieces 106, 108 joining together to form a support structure 122 for portable electronic devices. When these pieces are joined in this manner, a recessed area (e.g., defined by 181A, 181B) for a portable keyboard is formed by the shapes in the two pieces (See above discussion relative to FIGS. 39-42). In other embodiments, the recessed area (e.g., defined by 181A, 181B) for portable keyboard may not be utilized (See FIGS. 43, 44). The assembled portable stand in FIG. 36 shows that a support structure can be made with two simple interlocking pieces. The front of the structure having the means to locate and hold portable electronic devices. The rear of the structure being higher than the front to promote a forward slope of the portable electronic device and raises the screen of such a device to at, or near, eye level.

Figure 37:
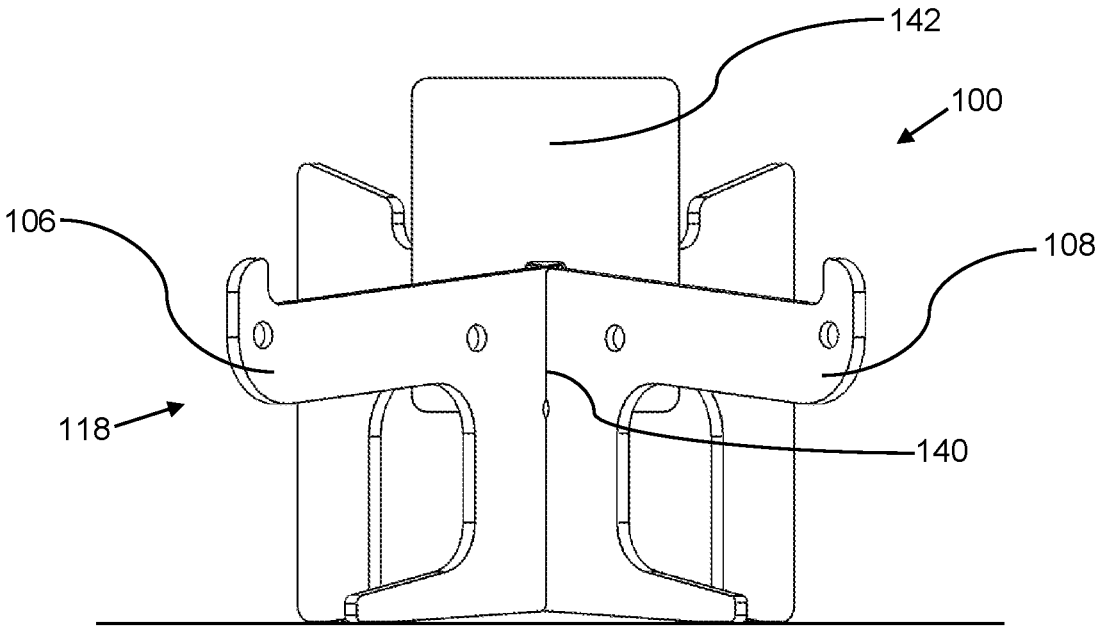
FIG. 37 illustrates, consistent with some embodiments, a perspective view of assembled portable stand with extender piece in place at the intersection of the top and bottom pieces.

Consistent with some embodiments, FIG. 37 shows portable stand 100 assembled into interlocking structure 118 with the extender piece 142 in an extended position providing a means for the screen of a portable electronic device to be raised to an additional level that is at, or near eye level (See FIGS. 39-42). With the extender piece 142 located at the intersection 140 of the top and bottom pieces 106, 108, it may also shift the center of gravity forward allowing for more stability in larger portable electronic devices.

Figure 38:
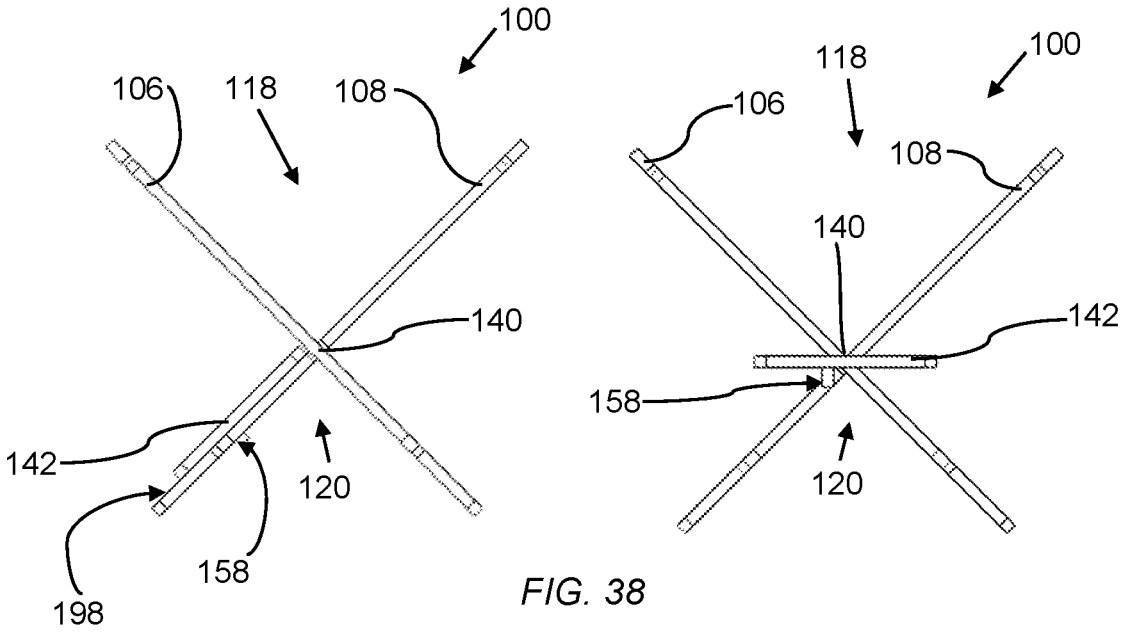
FIG. 38 illustrates, consistent with some embodiments, two top views of portable stand assembly with extender piece in stored position (left) and deployed in extending position (right). Note that the open design promotes cooling for portable electronic devices.

Consistent with some embodiments, FIG. 38 is a top view of the assembled portable stand in two different configurations. Both configurations show a portable stand 100 assembled into an interlocking structure 118 by the joinder of top piece 106 and bottom piece 108 and intersection 140. Since these views are both top views, X shape 120 is visible in each. On the left, a first configuration is shown with the extender piece 142 (with keeper pin 158 indicated) stored on the side 198 of top piece 106. On the right, a second configuration is shown and one with the extender piece 140 installed at the intersection 140 of the top and bottom pieces 106, 108. This open, simple design provides for cooling of portable electronic devices. In addition, this centrally cross joined design allows for additional workspace on the supporting structure of the portable stand by raising the portable electronic device, allowing room underneath for storage and working with other components such as a keyboard or mouse.

Figure 39:
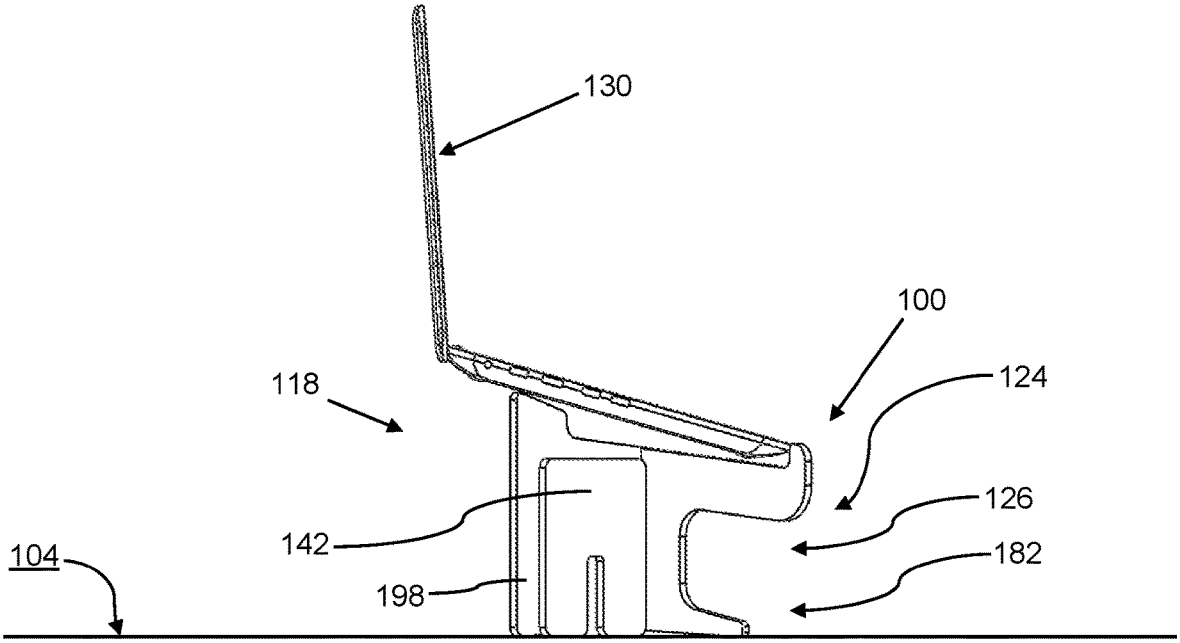
FIG. 39 illustrates, consistent with some embodiments, a side view of a laptop on the portable stand. Note that the design of this embodiment incorporates features that allow for the laptop to be supported at minimal locations, allowing for flexibility in laptop and portable electronic device models and designs.
Figure 40:
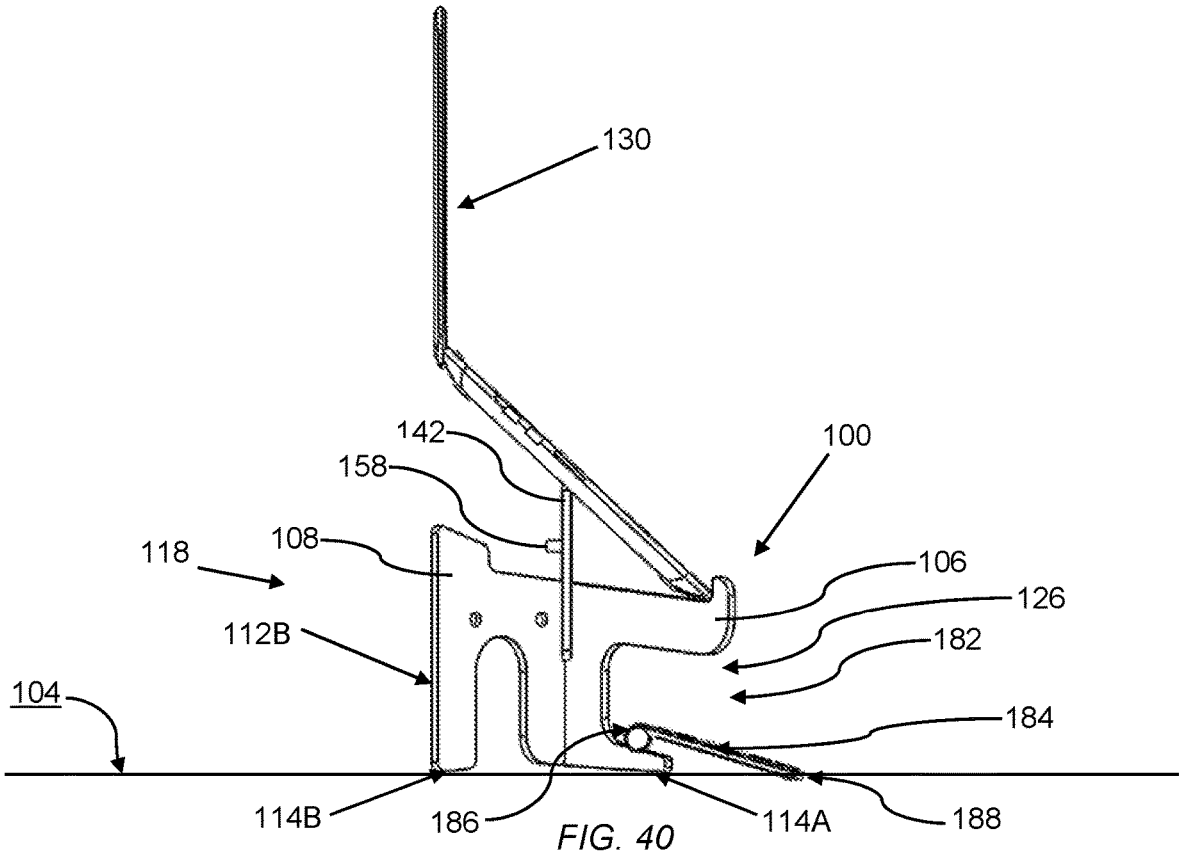
FIG. 40 illustrates, consistent with some embodiments, a side view of a portable stand with extender in use. Note that the design of some embodiments incorporates features that allow for the laptop to be supported at minimal locations, allowing for flexibility in laptop and portable electronic device models and designs.
Figure 41:
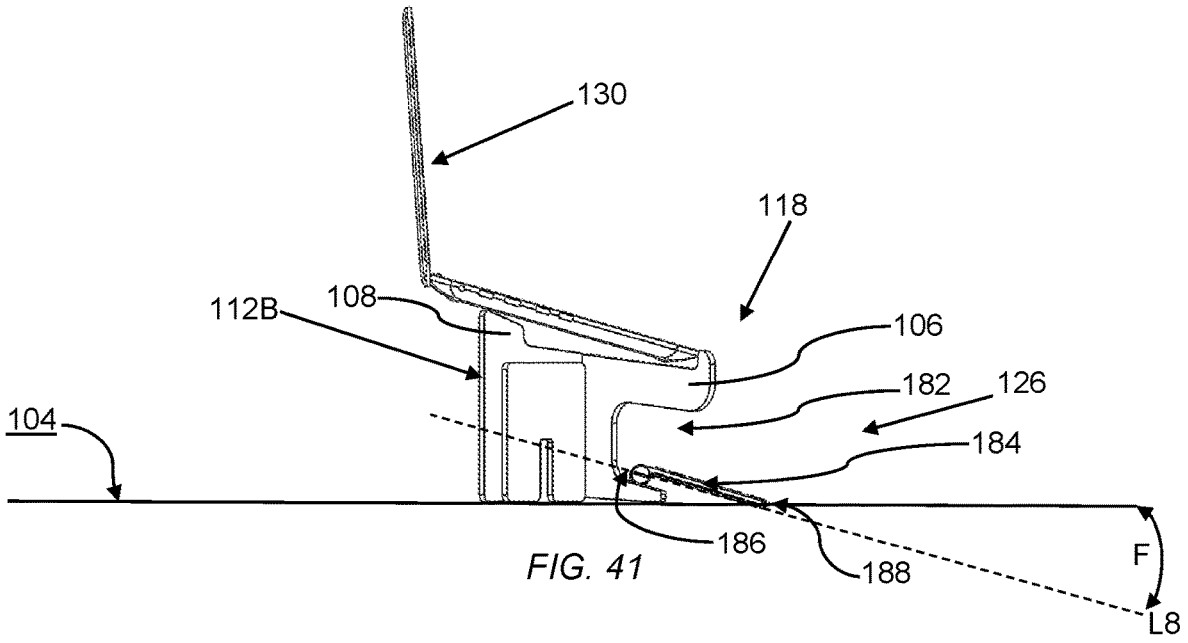
FIG. 41 illustrates, consistent with some embodiments, a side view of a portable stand bearing laptop computer and showing location for portable keyboard.
Figure 42:
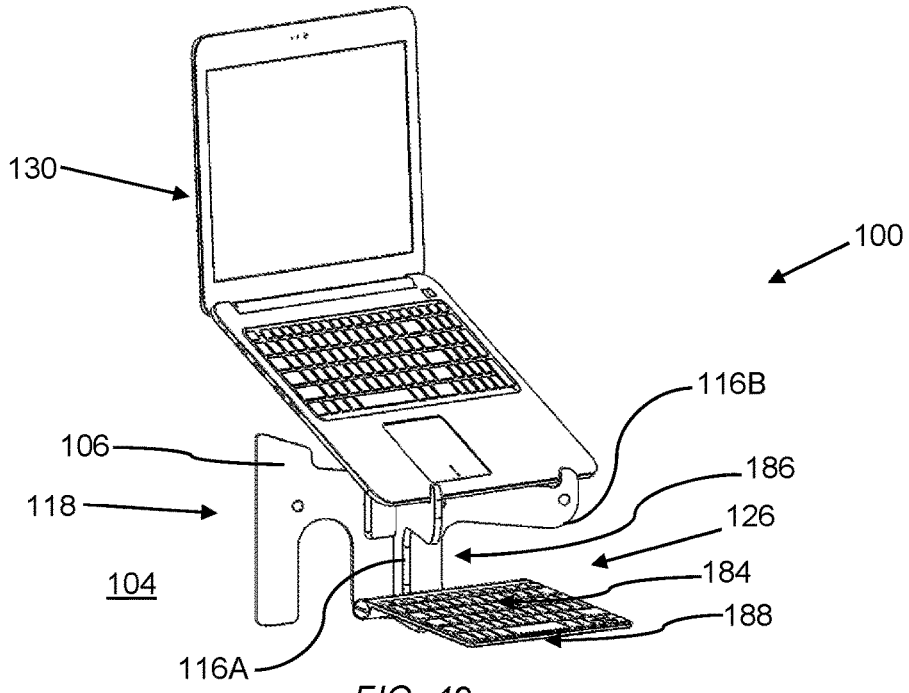
FIG. 42 illustrates, consistent with some embodiments, a perspective view of showing a portable stand, with extender piece in place, bearing a laptop computer and showing a location for portable keyboard.

Portable electronic devices may rest on top of a portable stand 100 in such a manner that it is tilted forward towards the user to allow for ease in typing and use. Consistent with some embodiments, FIG. 39 is a side view of one embodiment with a laptop computer 130 raised to at, or near, eye level (e.g., for a user, not shown, sitting to left of front side 124 of portable stand 100). The configuration shown in FIG. 39 is with the extender piece 142 in a stored side position. The extender piece 142 may be used to raise the level of the laptop 130 to another level that is at, or near, eye level as shown in FIG. 40 for additional comfort in working. In both configurations, extender piece 142 stored in the side 198 or installed at the intersection 140 of the top and bottom pieces, the portable stand design is amenable to use with a portable keyboard as shown in FIGS. 41 and 42. This Recessed area keyboard feature 182 of some embodiments allows for a user (not shown) to type in an ergonomic, manner with arms resting comfortably while the screen of the portable electronic device is raised to at or near eye level.

Figure 43:
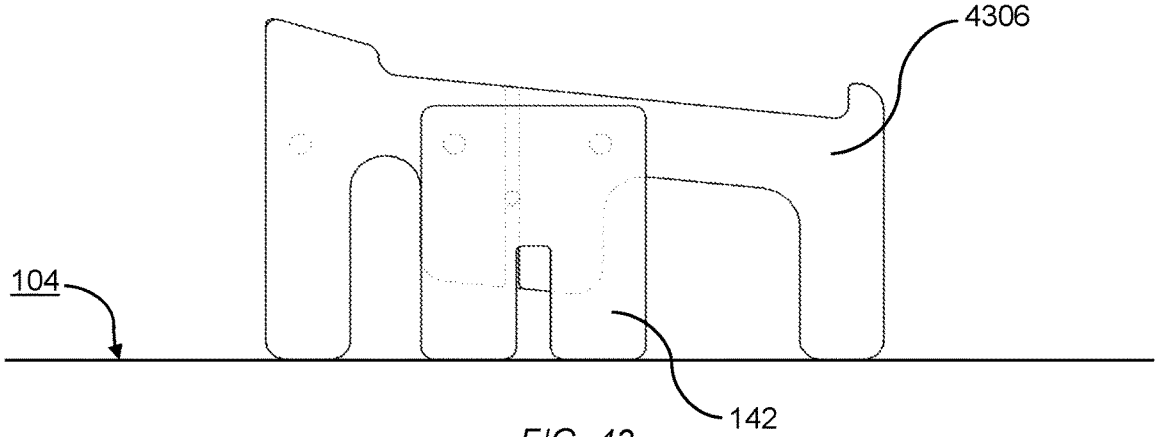
FIG. 43 illustrates, consistent with some embodiments, an embodiment with an alternative shape for top and bottom pieces, showing integration with extender piece.
Figure 44:
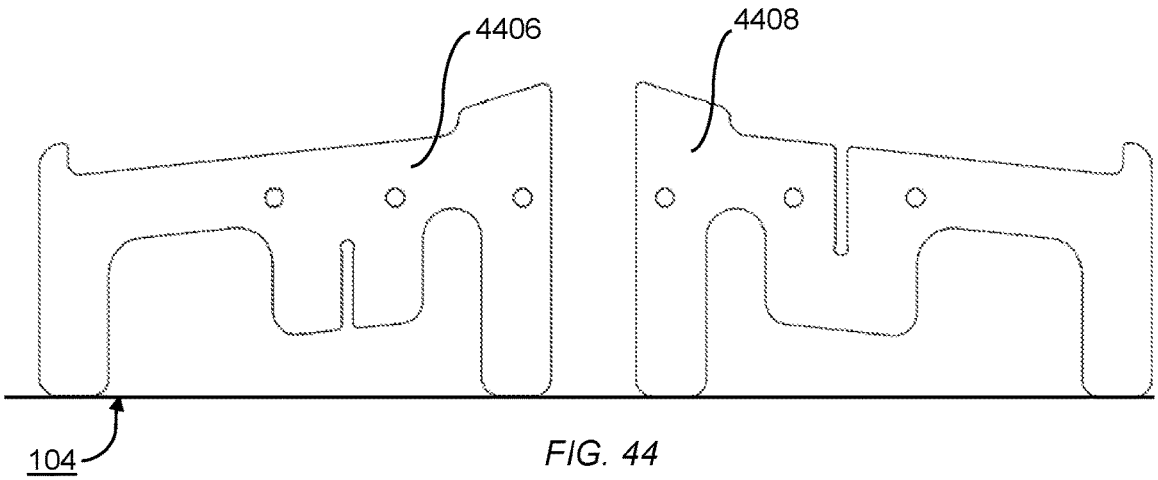
FIG. 44 illustrates, consistent with some embodiments, an embodiment with another alternative shape for top and bottom pieces.
Figure 45:
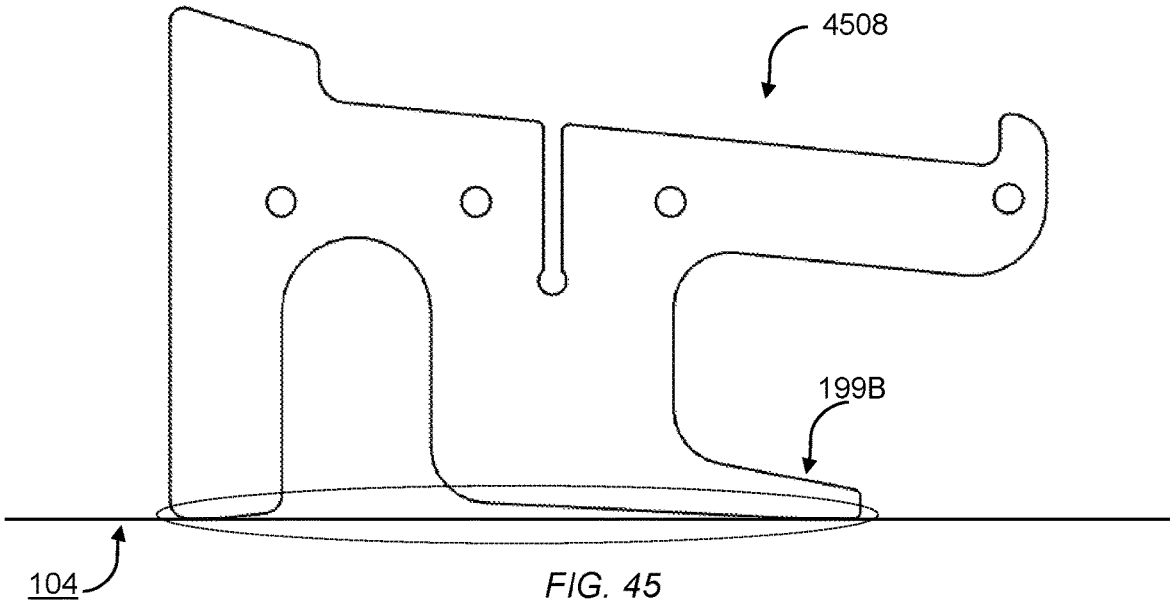
FIG. 45 illustrates an embodiment with another alternative shape for a bottom piece with bottom edge variation.
Figure 46:
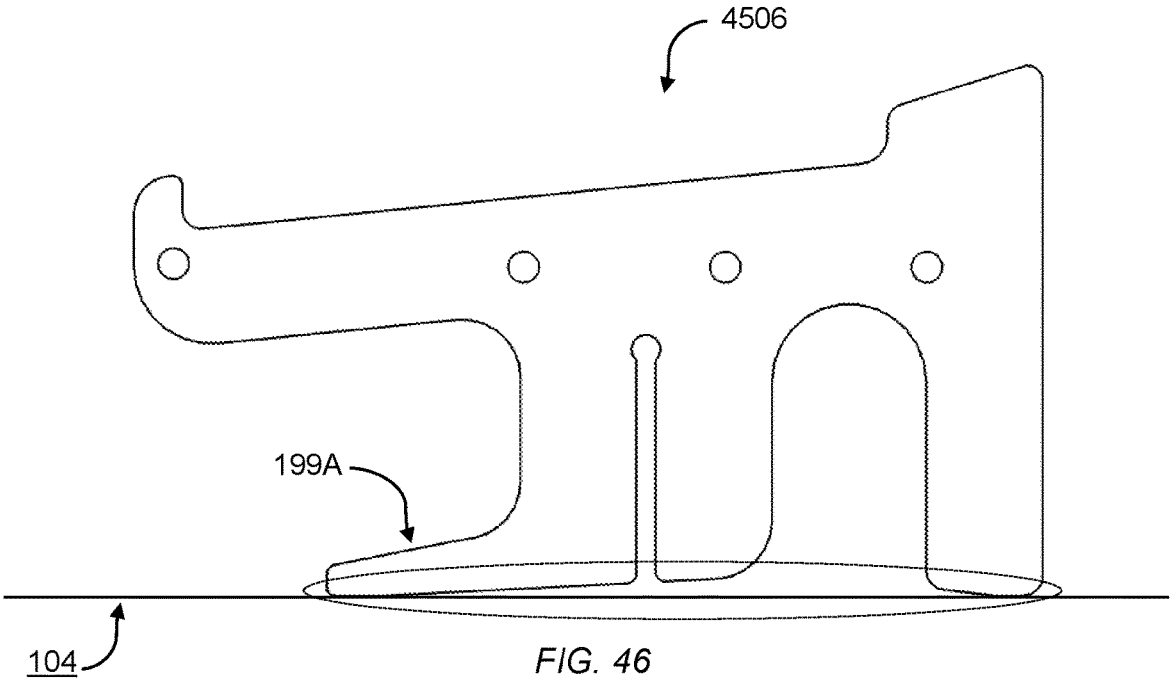
FIG. 46 illustrates an embodiment with another alternative shape for a top piece with bottom edge variation.

In addition to the concepts previously presented in this disclosure, there are other possible configurations that utilize the features already described but may include other possible variations. Consistent with some alternative embodiments, FIGS. 43 and 44 show one possible examples of alternate shapes for the top and bottom pieces. For example, referencing FIG. 43, top piece 4306 is shown above similarly shaped bottom piece (not shown) and supporting extension piece 142. The embodiment of FIG. 43 could also be used and contain many of the features previously presented herein. Similarly, referencing FIG. 44, alternative designs are embodied in top piece 4406 and bottom piece 4408. In addition, consistent with some alternative embodiments, FIGS. 45 and 46 show, respectively, bottom piece 4508 and top piece 4506 show a different configuration to bottom structures (e.g. 199A for top piece 4506 and 199B for bottom piece 199B) in the 'top and bottom pieces 4506 and 4508 that may be used to improve the stability of the portable stand by minimizing the contact surface between the stand and the flat supporting surface 104. Additionally, any of the proposed magnets may be used as additional means to secure accessories and other features of this device.

The above discussion of some embodiments is not exhaustive. Instead, one skilled in the art will appreciate additional alternatives and/or modifications that may be made to the discussed embodiments without departing from the inventive principles. The invention is therefore not intended to be limited by the above discussion but only by the following claims.

I claim:

1. A portable stand for supporting portable electronic devices when the portable stand is resting on a flat surface, the stand comprising:

a panel-shaped top piece defining at least one of first, second, third, or fourth edges;

a panel-shaped bottom piece defining at least one of first, second, third, or fourth edges, wherein the top and the bottom pieces are configured to be interlocked to form an interlocking structure; and wherein the interlocking structure is configured to be interchangeably positioned in at least two of:

a first position with at least a portion of the third edges of the top and bottom pieces resting on the flat surface and the first edges defining a support structure for supporting a laptop computer above the flat surface;

a second position with at least a portion of the second edges of the top and bottom pieces resting on the flat surface with the fourth edges defining a tablet slot for supporting a tablet computer above the flat surface; or a third position with at least a portion of the first edges of the top and bottom pieces resting on the flat surface with the third edges defining an e-reader slot for holding an e-reader above the flat surface.

2. The portable stand of claim 1, wherein the top piece defines a first alignment slot;

wherein the bottom piece defines a second alignment slot; and wherein the top and the bottom pieces are configured to be interlocked to form the interlocking structure by a mating of the first alignment slot with the second alignment slot.

3. The portable stand of claim 1, wherein the top and bottom pieces of the portable stand are configured to be interlocked without the use of fastening devices separate from the top and bottom pieces.

4. The portable stand of claim 1, wherein the interlocking structure is configured to be interchangeably placed in at least the first position and wherein when the interlocking structure is in the first position the support structure slopes toward a front-side of the interlocking structure and includes at least:

a middle portion of the support structure that is configured for supporting at least a first portion of a laptop; and first and second resting notches positioned to prevent a laptop computer resting on the support structure from sliding off of the support structure as it slopes toward the front-side of the interlocking structure.

5. The portable stand of claim 4, wherein the support structure further includes at least first and second resting slopes that are shaped to partially support a second portion of a laptop while the first portion of the laptop is at least partly supported by the middle portion.

6. The portable stand of claim 1, further comprising:

a panel-shaped extender piece that includes an extender notch that extends from an edge of the extender piece toward a top portion of the extender piece opposite the edge of the extender piece;

wherein the extender notch is configured to slide over and mate the extender piece to an intersection of first edges of the top and bottom pieces when the interlocking structure is in the first position; and wherein when the extender piece is mated to said intersection the top portion has a length configured for raising a downward slope of the support structure and thus increasing a downward slope of a laptop computer resting on the support structure.

7. The portable stand of claim 6, wherein the extender piece is configured to be detachably attached to a side of at least one of the top piece or the bottom piece for storage when not in use.

8. The portable stand of claim 7, wherein the extender piece is configured to be detachably attached to the side of at least one of the top piece or the bottom piece at least partly via one or more magnets attached to the extender piece aligning with one or more other magnets attached to the side of at least one of the top piece or the bottom piece.

9. The portable stand of claim 1, wherein, at least a portion of the top piece and at least a portion of the bottom pieces are of substantially identical shape and size; and wherein, when not interlocked to form the interlocking structure, the top and bottom pieces are configured to be stacked along respective flat surfaces.

10. The portable stand of claim 9, wherein the stacked top piece and bottom piece are configured to define a channel.

11. The portable stand of claim 10, further comprising a panel-shaped extender piece that includes an extender notch that extends from an edge of the extender piece toward a top portion of the extender piece opposite the edge of the extender piece; and wherein when the extender piece is configured to be stacked on top of the top and bottom pieces when the top and bottom pieces are stacked along the respective flat surfaces.

12. The portable stand of claim 11, further comprising a keeper pin affixed to the extender piece; and wherein the keeper pin of the extender piece is configured to fit into the channel and wherein when the keeper pin is so positioned within the channel, the extender piece is thereby stacked on top of the stacked top and bottom pieces with the keeper pin preventing sliding or shearing of the pieces relative to one another.

13. The portable stand of claim 12, wherein when the extender piece, the top piece, and the bottom piece are in this stacked position, a protrusion defined by the top piece and a substantially identical protrusion defined by the bottom piece collectively provide a handle for carrying the stacked structures.

14. The portable stand of claim 13, further comprising a plurality of magnets attached to the extender piece, the top piece, and the bottom piece;

wherein the attached plurality of magnets are positioned and aligned to at least partly secure the extender piece, the top piece, and the bottom piece in the stacked position and thereby prevent sliding or shearing of the pieces relative to one another.

15. The portable stand of claim 14, wherein the plurality of magnets are positioned and aligned by being disposed within corresponding and strategically placed holes that extend at least partly through sides of the extender piece, the top piece, and the bottom piece.

16. The portable stand of claim 1, wherein the interlocking structure defines an intersection, the intersection shaped and configured to receive and mate with a panel-shaped extender piece to increase a downward slope of the support structure.

17. The portable stand of claim 1, wherein the interlocking structure is configured to be interchangeably positioned in at least the first position and wherein when the interlocking structure is in the first position the support structure is shaped to slope between 5 and 15 degrees downward relative to horizontal, the horizontal being relative to the flat surface.

18. The portable stand of claim 1, wherein the interlocking structure is configured to be interchangeably positioned in at least the second position and wherein when the interlocking structure is in the second position the tablet slot is configured for supporting a tablet computer in an orientation between 0 and 30 degrees of vertical relative to the flat surface.

19. The portable stand of claim 1, wherein the interlocking structure is configured to be interchangeably positioned in at least the third position and wherein when the interlocking structure is in the third position the e-reader slot is configured for holding an e-reader in an orientation between 0 and 45 degrees of vertical relative to the flat surface.

20. A portable stand for supporting portable electronic devices when the portable stand is resting on a flat surface, the stand comprising:

a panel-shaped top piece defining one or more edges;

a panel-shaped bottom piece defining one or more edges, wherein the top and the bottom pieces are configured to be interlocked to form an interlocking structure; and wherein the interlocking structure is configured to be interchangeably positioned in at least two of:

a first position with at least a first portion of the interlocking structure resting on the flat surface and with at least a first one of the one or more edges of the top piece and at least a first one of the one or more edges of the bottom piece defining a support structure for supporting a laptop computer above the flat surface;

a second position with at least a second portion of the interlocking structure resting on the flat surface and with at least a second one of the one or more edges of the top piece and at least a second one of the one or more edges of the bottom piece defining a tablet slot for supporting a tablet computer above the surface; or a third position with at least a third portion of the interlocking structure resting on the flat surface and with at least a third one of the one or more edges of the top piece and at least a third one of the one or more edges of the bottom piece defining an e-reader slot for holding an e-reader above the flat surface.

* * * * *